US007520406B2

(12) United States Patent
Jaichandra et al.

(10) Patent No.: US 7,520,406 B2
(45) Date of Patent: Apr. 21, 2009

(54) DEVICE FOR DISPENSING A CONTROLLED DOSE OF A FLOWABLE MATERIAL

(75) Inventors: Doraiswami Jaichandra, Racine, WI (US); Gerard Michael O'Brien, Hertfordshire (GB); George Reeves, Bucks (GB); Michael E. Klinkhammer, Racine, WI (US); Steven A. Zach, Racine, WI (US); Chris A. Kubicek, East Troy, WI (US); Nathan R. Westphal, Union Grove, WI (US)

(73) Assignee: S. C. Johnson & Son, Inc., Racine, WA (US)

( * ) Notice: Subject to any disclaimer, the term of this patent is extended or adjusted under 35 U.S.C. 154(b) by 465 days.

(21) Appl. No.: 11/177,460

(22) Filed: Jul. 8, 2005

(65) Prior Publication Data

US 2007/0007302 A1 Jan. 11, 2007

(51) Int. Cl.
*B67D 5/22* (2006.01)

(52) U.S. Cl. ..... 222/47; 222/386

(58) Field of Classification Search ..... 222/47–50, 222/173, 184, 185.1, 386
See application file for complete search history.

(56) References Cited

U.S. PATENT DOCUMENTS

| | | | | | |
|---|---|---|---|---|---|
| 635,961 | A | * | 10/1899 | Hasson | 134/169 R |
| 939,198 | A | * | 11/1909 | Allen | 222/47 |
| 2,789,731 | A | * | 4/1957 | Marraffino | 222/129 |
| 3,162,884 | A | * | 12/1964 | Bordwine et al. | 401/12 |
| 3,229,865 | A | * | 1/1966 | Heisler et al. | 222/391 |
| 3,357,427 | A | * | 12/1967 | Wittke et al. | 604/226 |
| 3,926,343 | A | * | 12/1975 | Kleiner | 222/145.5 |
| 3,934,586 | A | * | 1/1976 | Easton et al. | 604/208 |
| 4,252,507 | A | | 2/1981 | Knickerbocker | |
| 4,257,267 | A | * | 3/1981 | Parsons | 73/864.14 |
| 4,273,257 | A | | 6/1981 | Smith et al. | |
| 4,339,058 | A | * | 7/1982 | Wendt | 222/309 |
| 4,445,626 | A | * | 5/1984 | Steffen et al. | 222/39 |
| 4,467,942 | A | * | 8/1984 | Oshikubo | 222/44 |
| 4,485,943 | A | | 12/1984 | Czech | |
| 4,658,993 | A | * | 4/1987 | Vlasich | 222/390 |
| 4,694,977 | A | * | 9/1987 | Graf et al. | 222/259 |
| 4,852,772 | A | * | 8/1989 | Ennis, III | 222/386 |
| 4,944,430 | A | * | 7/1990 | Graf et al. | 222/259 |

(Continued)

FOREIGN PATENT DOCUMENTS

DE 956 298 1/1957

(Continued)

*Primary Examiner*—Kevin P Shaver
*Assistant Examiner*—Andrew P Bainbridge

(57) ABSTRACT

A device for applying controlled unitized doses of a flowable material to a surface is disclosed. The device includes a tubular body and a plunger. The body has a wall defining a cavity, and the body has a first open end and an opposite second end having a dispensing orifice. A flowable material is contained in the cavity of the body. The plunger has an outer sleeve dimensioned for surrounding at least a section the body and an inner pushing structure dimensioned for axial movement in the cavity of the body. The device has means for indexed positioning of the second end of the body and an inner end of the inner pushing structure of the plunger relative to each other to provide controlled unitized doses of the flowable material to a surface when the plunger is moved toward the body by a user's hand.

25 Claims, 17 Drawing Sheets

U.S. PATENT DOCUMENTS

| | | | | | |
|---|---|---|---|---|---|
| 4,962,868 | A | * | 10/1990 | Borchard | 222/49 |
| 4,994,065 | A | * | 2/1991 | Gibbs et al. | 606/92 |
| 5,000,356 | A | * | 3/1991 | Johnson et al. | 222/391 |
| 5,219,448 | A | * | 6/1993 | Hackmann | 401/176 |
| 5,421,663 | A | * | 6/1995 | Bravo | 401/82 |
| 5,622,288 | A | * | 4/1997 | Boring | 222/327 |
| 5,636,933 | A | * | 6/1997 | Vizsolyi | 401/269 |
| 5,718,357 | A | * | 2/1998 | Dang | 222/153.06 |
| 5,746,357 | A | | 5/1998 | Beveridge et al. | |
| 5,782,815 | A | * | 7/1998 | Yanai et al. | 604/218 |
| 6,189,743 | B1 | * | 2/2001 | Hough | 222/386 |
| 6,273,152 | B1 | | 8/2001 | Buehler et al. | |
| 6,322,821 | B1 | * | 11/2001 | Register | 424/678 |
| 6,513,680 | B2 | * | 2/2003 | Nakayoshi et al. | 222/1 |
| 6,667,286 | B1 | * | 12/2003 | Dettinger et al. | 510/191 |
| 6,705,492 | B2 | * | 3/2004 | Lowry | 222/184 |
| 6,732,872 | B1 | * | 5/2004 | Gregro et al. | 215/11.3 |
| 2001/0004081 | A1 | * | 6/2001 | Tansley et al. | 222/61 |
| 2005/0158116 | A1 | * | 7/2005 | Belansky et al. | 401/270 |
| 2007/0007302 | A1 | * | 1/2007 | Jaichandra et al. | 222/47 |

FOREIGN PATENT DOCUMENTS

| | | | | |
|---|---|---|---|---|
| DE | 3321210 | | | 12/1984 |
| DE | 4134911 | | | 4/1993 |
| DE | 4134911 | A1 | * | 4/1993 |
| DE | 44 36 286 | A1 | | 4/1996 |
| DE | 196 18 179 | A1 | | 11/1997 |
| EP | 0 457 452 | A2 | | 11/1991 |
| EP | 1 258 571 | A2 | | 11/2002 |
| WO | WO 03/043906 | A1 | | 5/2003 |
| WO | WO 03/097947 | A1 | | 11/2003 |
| WO | WO 2004/043825 | A1 | | 5/2004 |

* cited by examiner

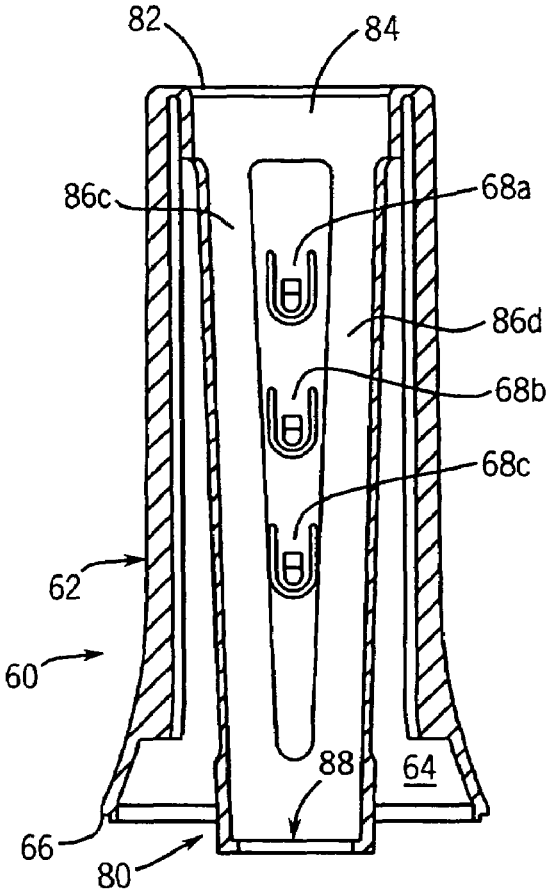
FIG. 8
FIG. 9
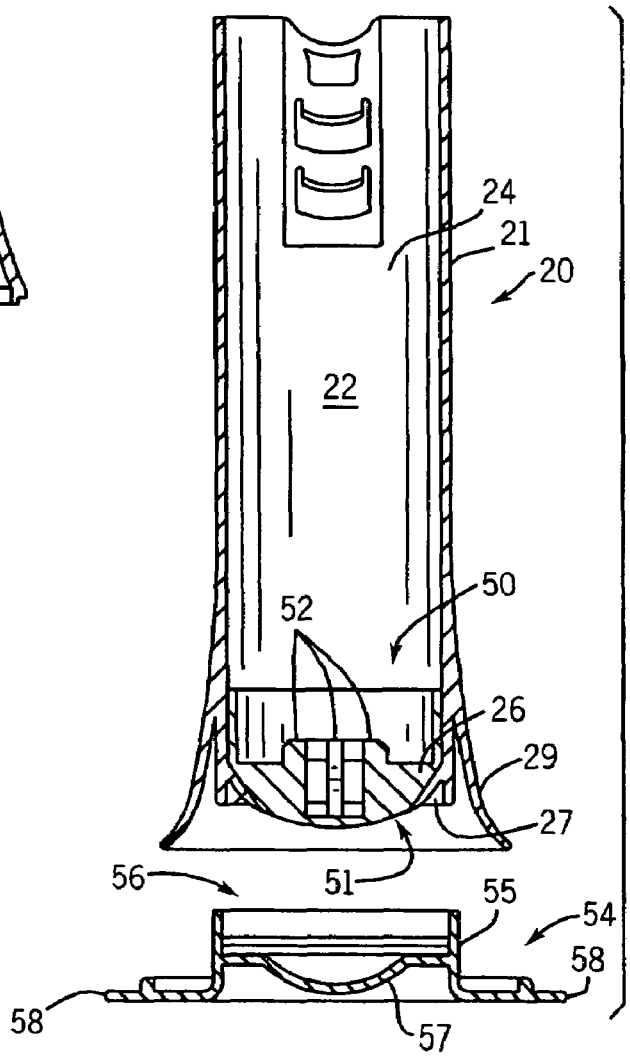

FIG. 13c
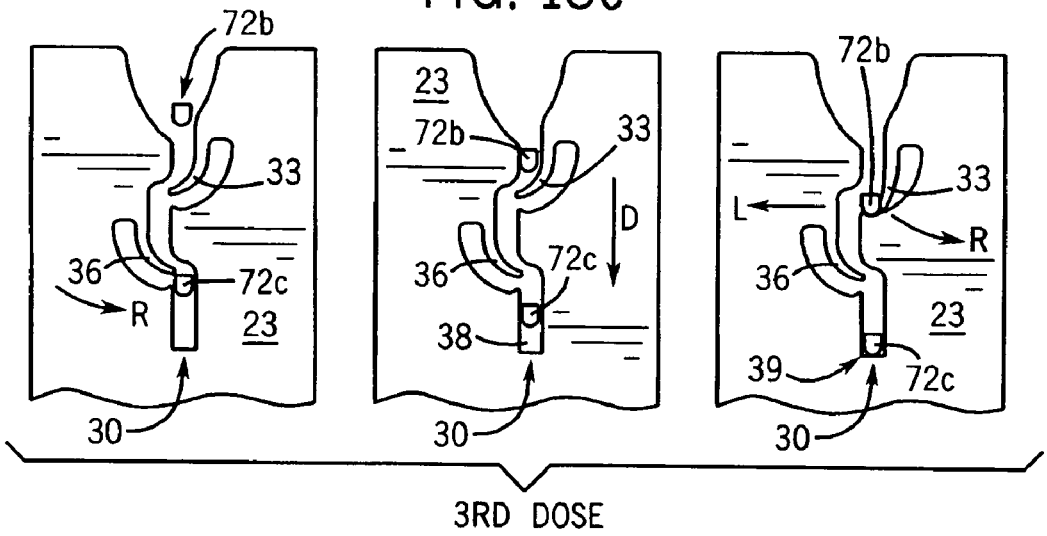
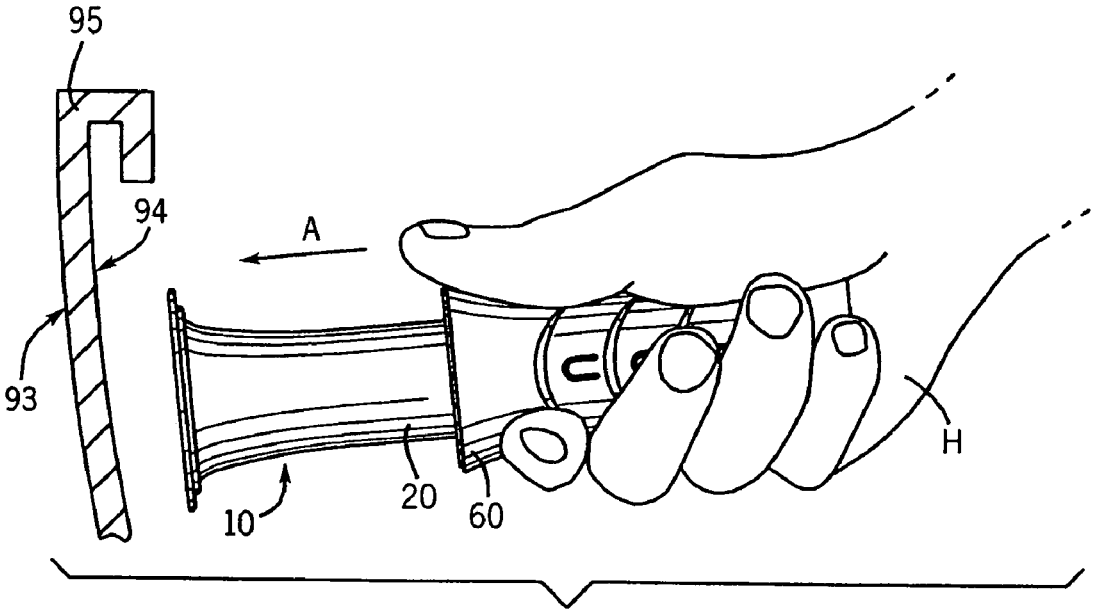
FIG. 14

DEVICE FOR DISPENSING A CONTROLLED DOSE OF A FLOWABLE MATERIAL

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to a device for dispensing controlled doses of a flowable material, and more particularly to a device for applying controlled doses of a flowable adhesive material to a surface.

2. Description of the Related Art

U.S. Pat. No. 6,667,286 describes a viscous gel-like substance that may be applied directly to the inner surface of a toilet bowl for cleaning and/or disinfecting and/or fragrancing the toilet bowl. The substance can be applied from a suitable applicator directly onto the inner surface of the toilet bowl, to which the substance adheres. The substance remains on the inner surface of the toilet bowl even after being contacted with flush water, and typically the substance is only flushed away completely after a large number of flushes. The substance is also suitable for application to other surfaces such as urinals, lavatory or industrial sinks, showers, bathtubs, dishwashing machines and the like.

Various applicators for such adhesive gel-like substances have been proposed. For example, PCT International Patent Application WO 03/043906 discloses a syringe-type dispensing device suitable for use in applying such adhesive gel-like substances to a surface. PCT International Patent Application WO 2004/043825 also discloses a syringe-type dispensing device for applying such adhesive gel-like substances to a surface.

While these applicators do succeed in applying the adhesive gel-like substances to a surface, some users of these applicators have difficulty deciding when to stop applying the adhesive gel-like substances to a surface. For instance, some users continue pressing on the plunger of the syringe and apply a bead of the adhesive gel-like substance around the entire circumference of the inner surface of the toilet bowl. This leads to overuse of the adhesive gel-like substance and an unnecessarily quick need for refill of the syringe or replacement purchase in the case of a disposable device. Another problem is that some users do not apply enough of the substance which minimizes efficacy of substance.

Thus, there is a need for an improved device for applying a flowable adhesive material to a surface such that a user can apply a unitized discrete controlled dose accurately and thereby avoid (i) overuse and waste of the adhesive material or (ii) underuse and decreased efficacy of the material.

SUMMARY OF THE INVENTION

The foregoing needs are met by a device according to the invention for applying controlled and accurate doses of a flowable adhesive material to a surface. The device includes a tubular body and a plunger. The body has a wall defining a cavity, and the body has a first open end and an opposite second end having a dispensing orifice. A flowable adhesive material is contained in the cavity of the body filled between the dispensing orifice and the first end. The plunger has an outer sleeve dimensioned for surrounding at least a section of the body and an inner pushing structure dimensioned for axial movement in the cavity of the body. The device has means for indexed positioning of the second end of the body and an inner end of the inner pushing structure of the plunger relative to each other to provide controlled doses of the flowable adhesive material such that the controlled unitized doses of the flowable adhesive material may be applied to the surface when the plunger (also called the "holder") is moved toward the body by a user.

An end of the outer sleeve of the plunger may be outwardly flaring to provide for a shield for the user's hand and a good grip. The second end of the body may have an end wall having a concave inner surface, and the inner end of the pushing structure of the plunger may have a convex outer surface that substantially conforms to the concave inner surface of the end wall of the second end of the body such that substantially all material is extruded from the body and out of the dispensing orifice. The inner end of the pushing structure may comprise a piston head.

The means for indexed positioning of the body and plunger during use may comprise a guide track and a guide pin that travels stepwise in the guide track. One of the guide track and the guide pin may be located on an outer surface of the body, and the other of the guide track and the guide pin may be located on an inner surface of the outer sleeve of the plunger. In one form, the guide pin is located on an inner surface of the outer sleeve of the plunger, and the guide track is located on the outer surface of the body. In another form, the means for indexed positioning comprises a guide track and a guide pin that travels stepwise in the guide track wherein the guide pin is located on an inner surface of the body and the guide track is located on the plunger. In another form, the means for indexed positioning comprises a guide track and a guide pin that travels stepwise in the guide track where the guide track has a serpentine path. The guide track may include at least one resilient arm for moving the guide pin laterally along a length of the guide track after the guide pin has been stopped in the guide track at the end of a dose. Specifically, each resilient arm moves the guide pin laterally after the guide pin contacts a shoulder at a perimeter region of the guide track. In another form, the means for indexed positioning comprises a guide track and a guide pin that travels stepwise in the guide track wherein the guide pin is movably located on an outer surface of the body and the guide track is located on the plunger wherein the guide track comprises a plurality of aligned throughholes dimensioned to receive the guide pin. The means for indexed positioning provides for delivery of controlled accurate unitized doses of material as the body and plunger move in an axial indexed stepwise controlled manner in relation to each other.

The device may further include means for creating a sound for audible feedback as the guide pin travels stepwise in the guide track. In one form, the means for creating a sound comprises a click pin and at least one click slot. The click pin may be located on the outer sleeve of the plunger and each click slot may be located in the wall of the body. Each click slot allows the click pin to spring inward to cause a clicking sound from contacting the body as the guide pin travels stepwise in the guide track. Each clicking sound is synchronized with the end of each dose of the material.

In one form, the pushing structure of the plunger includes a pushing frame and a separate piston head, and the pushing frame engages the piston head. In another form, the pushing structure includes a separate piston, and an inner surface of the pushing structure engages the piston.

The body may include a shroud that extends away from the second end of the body and surrounds the dispensing orifice. The shroud restricts the outward spread of the material inside the shroud when the material is applied to a surface. The bottom edge of the shroud provides for contact with the surface on which the material is being dispensed, and the distance between the dispensing orifice and the bottom edge of the shroud defines the thickness and diameter of flowable material dispensed onto the surface.

In another aspect, the invention provides a refill for the device for dispensing controlled doses of a flowable material wherein the device includes a plunger having an outer sleeve with an inwardly directed guide pin. The refill includes a tubular body having a wall defining a cavity. The body has a first open end and an opposite second end having a dispensing orifice, and the body has a guide track in an outer surface of the body. In the refill, a flowable material is contained in the cavity, and a piston head is optionally located in the first open end of the cavity depending on the structure of the plunger. The guide track is structured such that the guide pin travels stepwise in the guide track. The flowable material may be an adhesive gel suitable for application to a hard surface that can be cleaned with water washing over the hard surface, or an adhesive gel suitable for application to a toilet, urinal, bathtub or shower. The guide track may have a serpentine path, and may include at least one resilient arm for moving the guide pin laterally along a length of the guide track. The body may include a shroud that extends away from the second end of the body and surrounds the dispensing orifice. The first open end of the body and/or the dispensing orifice may be covered with a removable seal, and preferably the dispensing orifice is circular for ease of application of a circular disc of material to a surface.

In yet another aspect, the invention provides a refill for the device for dispensing controlled doses of a flowable material wherein the device includes a plunger having an outer sleeve with a guide track comprising throughholes in the outer sleeve of the plunger. The refill includes a tubular body having a wall defining a cavity. The body has a first open end and an opposite second end having a dispensing orifice. The body has a guide pin movably attached to an outer surface of the body, and a flowable material in the cavity. The guide pin is dimensioned to be received in the throughholes of the guide track.

In one example embodiment, the dispensing device has a body, a plunger, a piston head and a cap. The body has two sets of tracks at a certain pitch to give the desired dosage. Each set has two tracks of different configuration, first, a serpentine track with shoulders to stop the plunger when the plunger is pushed, and second, a channel to provide an audible feedback (a click) to the user. The body also has a piston head inserted within the body such that a convex outer surface of the piston head is in phase with a concave shape of the inside of the dispensing orifice. In addition to the dispensing orifice, there is a shroud around the orifice with a flat contact surface that comes in contact with the hard surface to apply against. The distance between the contact surface of the shroud and the dispensing orifice is important in defining the diameter and thickness of the material applied to the surface, which in turn defines length of life and efficacy of the material applied to the surface. The piston head is structurally configured to accept a pushing structure of the plunger. The plunger has two sets of three spring loaded pins that are spaced twice the pitch of the guide tracks such that when the plunger is pushed against the hard surface, one set of pins mates with the corresponding set of tracks, giving 3×2=6 doses of material.

In a second example embodiment, the dispensing device has a body, a plunger, a piston head and a cap. The plunger has a guide track at a certain pitch to give the desired dosage. The guide track has a serpentine track with six shoulders to stop a guide pin on the body when the plunger is pushed. When an inner sleeve of the plunger is inserted in the body, the guide pin enters the guide track. The user will butt the contact surface of the shroud of the body against the hard surface and push the plunger causing the guide pin to move and stop at the next shoulder in the guide track to complete one dose.

In a third example embodiment, the dispensing device has a body, a plunger, a piston head and a cap. The outer sleeve of the plunger has six throughholes at a pitch to give the desired dose of material. When an inner sleeve of the plunger is inserted in the body, a spring loaded pin of the body snaps into a first throughhole in the plunger. The user will butt the contact surface of the shroud of the body against the hard surface and push the plunger while pressing the head of the pin and causing the pin to move and snap into the next throughhole to complete one dose.

These and other features, aspects, and advantages of the present invention will become better understood upon consideration of the following detailed description, drawings, and appended claims.

BRIEF DESCRIPTION OF THE DRAWINGS

FIG. 8 is a cross-sectional view of a plunger of the dispensing device taken along line 8-8 of FIG. 3.

FIG. 9 is a cross-sectional view of the flowable material containing body, piston, and cap of the dispensing device taken along line 9-9 of FIG. 3.

FIGS. 13*a*-13*c* are detailed views showing the movement of the guide pin in the guide track of the means for indexing the plunger on the flowable material containing body of the dispensing device.

FIG. 14 shows the use of the dispensing device in applying a controlled dose of a cleaning, disinfecting and/or fragrancing adhesive gel to the inner surface of a toilet bowl.

Like reference numerals will be used to refer to like parts from Figure to Figure in the following description of the drawings.

DETAILED DESCRIPTION OF THE INVENTION

Figure 1:
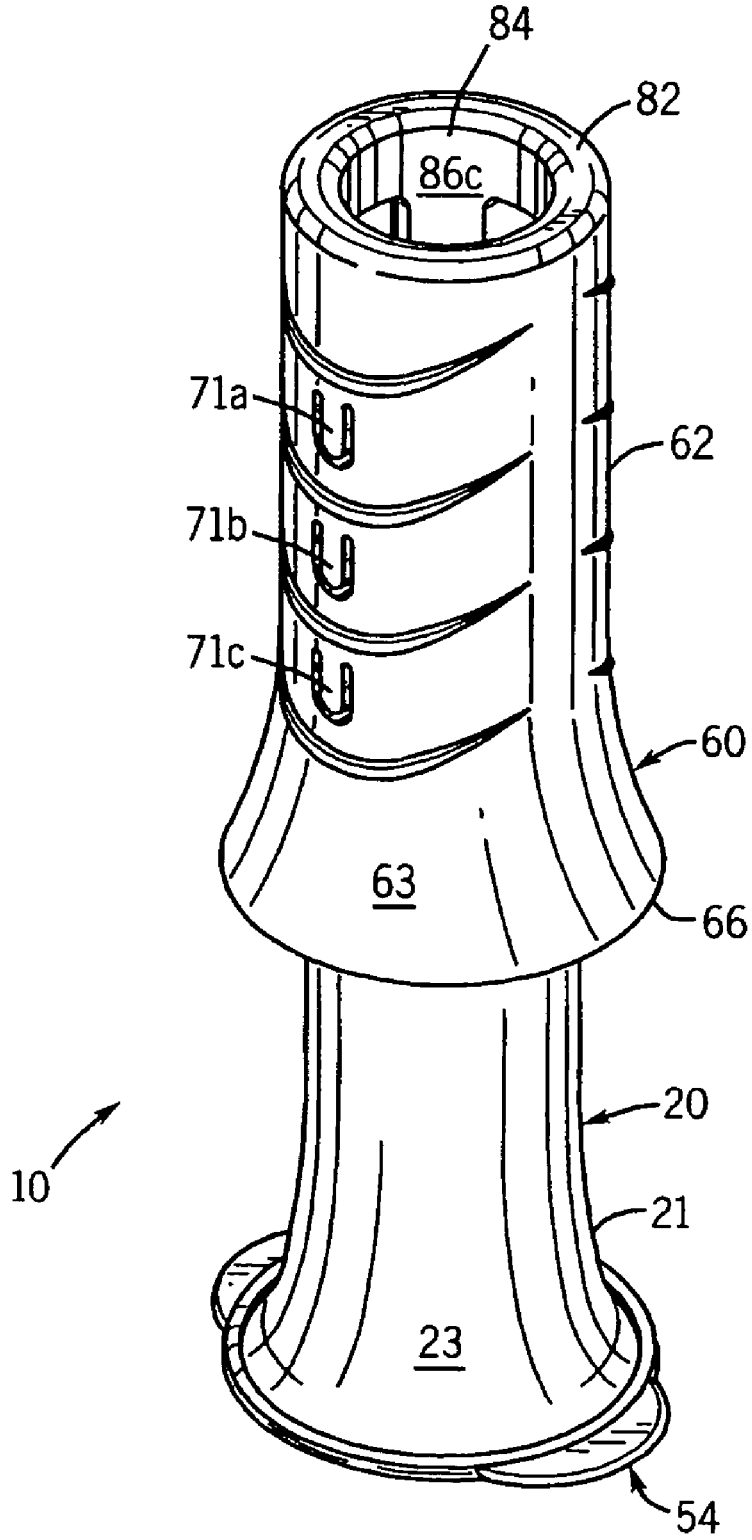
FIG. 1 is an upper right front perspective view showing a dispensing device according to the invention.

Referring first to FIGS. 1 to 13*c*, there is shown one embodiment of a dispensing device 10 according to the invention. The device 10 can accurately apply controlled unitized doses of a flowable adhesive material to a surface. In one example use, the device 10 may be used for applying controlled doses of a cleaning, disinfecting and/or fragrancing flowable adhesive gel to the surface of a toilet, urinal, bathtub, shower or the like. One example gel is described in U.S. Pat. No. 6,667,286, which is incorporated herein by reference along with all other documents cited herein. Such a gel has a viscosity of at least 15,000 mPa. The device 10 includes a tubular body 20 that contains the flowable material and a plunger 60 that pushes the flowable material from the tubular body 20 onto the surface. A cap 54 covers the tubular body opening during storage. Typically, all of the components of the device 10 are constructed from a polymeric material such as translucent or opaque polyethylene or polypropylene.

Figure 6:
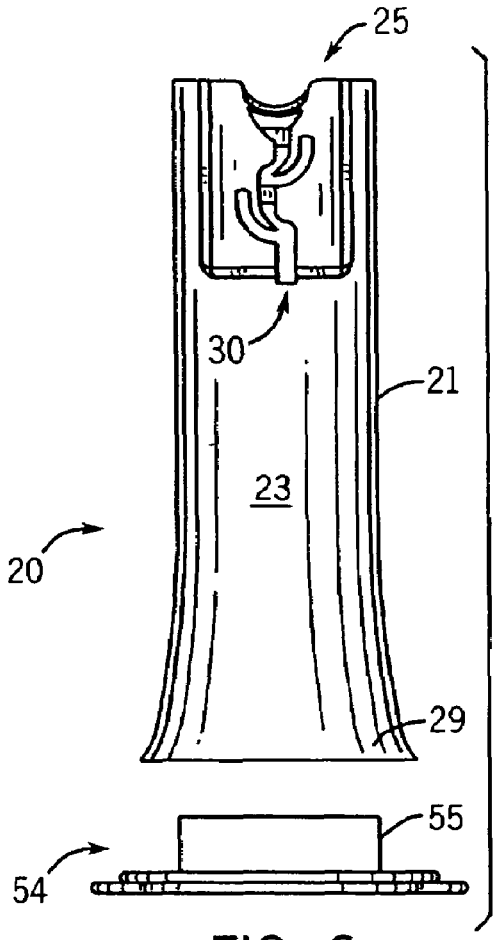
FIG. 6 is a front plan view of a flowable material containing body and a cap of the dispensing device of FIG. 1.
Figure 7:
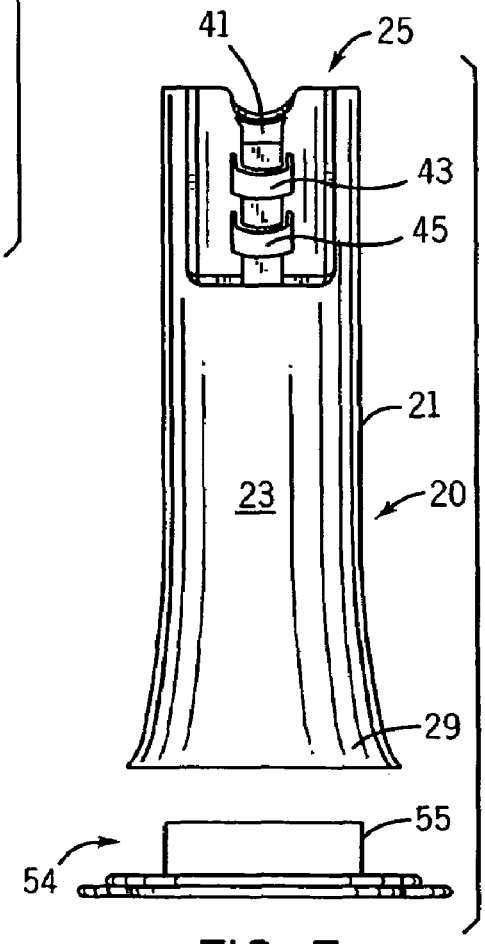
FIG. 7 is a rear plan view of the flowable material containing body and cap of FIG. 6.

Looking at FIGS. 6, 7 and 9, the body 20 has a generally tubular cylindrical wall 21 that defines a cavity 24 for containing the flowable material (which is not shown in FIG. 9). The wall 21 has an inner surface 22 and an outer surface 23. The body 20 has a first anterior open end 25 and an opposite posterior end 26 that has a wall with a concave inner surface 27 and a circular dispensing orifice 28 (see FIG. 15*a*). The end 26 also has an outwardly flaring shroud 29 that surrounds the orifice 28. Looking at FIG. 9, the cap 54 is provided for sealing off the orifice 28 during shipping, storage and between uses. The cap 54 includes an upward circular wall 55 that forms a well 56 which has a concave lower inner surface 57 that substantially conforms to the concave inner surface 27 of the end wall 26 of the body 20. This provides a tight seal between the cap 54 and the body 20. Ears 58 are provided on the cap 54 for ease of removal of the cap 54 from the body 20. The cap 54 may also be sized for engagement in a docking station that rests on a surface such as a floor.

Figure 2:
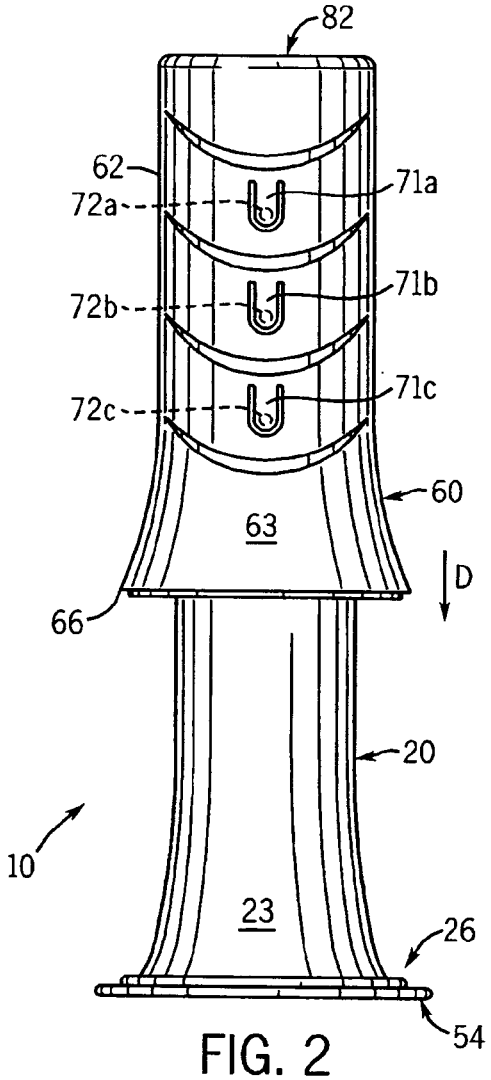
FIG. 2 is a front elevational view of the dispensing device of FIG. 1.
Figure 3:
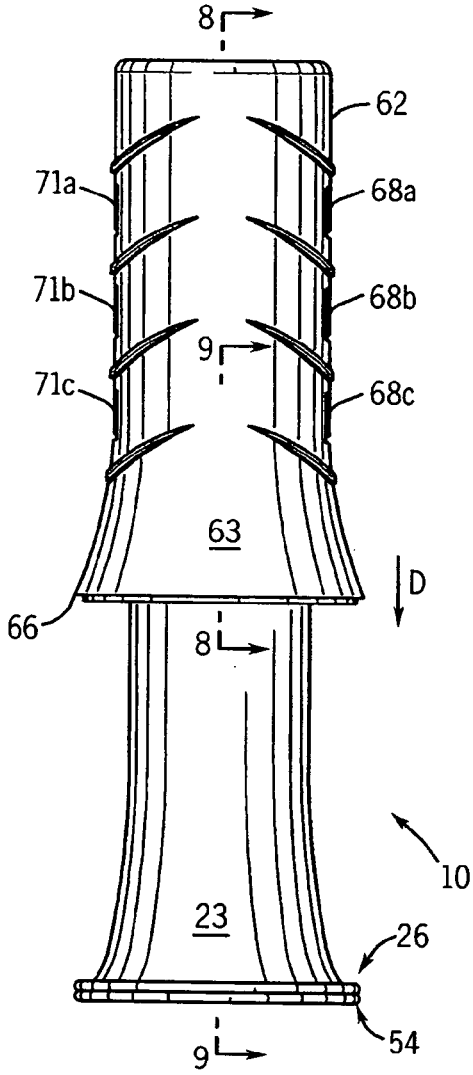
FIG. 3 is a right side view of the dispensing device of FIG. 1.

Referring to FIGS. 1-3 and 8, the plunger 60 has a generally tubular cylindrical outer sleeve 62 having an outer surface 63 and an inner surface 64. The outer sleeve 62 terminates in an outwardly flaring end 66. The outer sleeve 62 has cut out tabs 71*a*, 71*b* and 71*c* formed by U-shaped slits that extend through the outer sleeve 62. Each of the cut out tabs 71*a*, 71*b* and 71*c* has a guide pin that extends inward from the inner surface 64 of the outer sleeve 62. See, for example, FIG. 12, which shows guide pin 72*c* that extends inward from cut out tab 71*c*. Also, FIG. 2 shows the inwardly directed guide pins 72*a*, 72*b*, 72*c* in phantom. The outer sleeve 62 also has cut out tabs 68*a*, 68*b* and 68*c* formed by U-shaped slits that extend through the outer sleeve 62. The cut out tabs 68*a*, 68*b* and 68*c* are 180 degrees opposite the cut out tabs 71*a*, 71*b* and 71*c*. Cut out tabs 68*a*, 68*b* and 68*c* each have inwardly directed click pins 69*a*, 69*b* and 69*c* respectively (see FIG. 10*a*) that extend inward from the inner surface 64 of the outer sleeve 62. The same dimensioned pin is used on both sides of the plunger 60 for the guide pins 72*a*, 72*b* and 72*c* and click pins 69*a*, 69*b*, 69*c* to allow 180 degrees rotation thereby enabling the applicator to be assembled in both orientations. The function of the guide pins 72*a*, 72*b* and 72*c* and click pins 69*a*, 69*b*, 69*c* will be described below.

Figure 4:
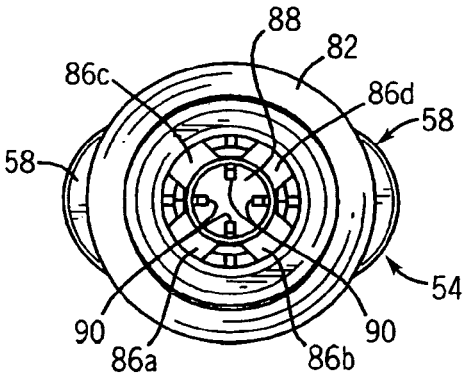
FIG. 4 is a top plan view of the dispensing device of FIG. 1.
Figure 5:
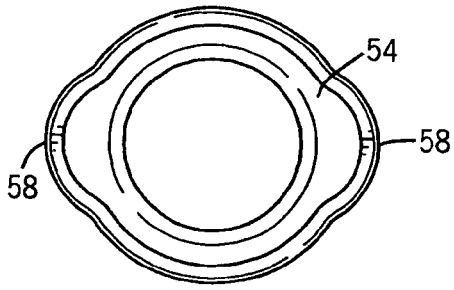
FIG. 5 is a bottom plan view of the dispensing device of FIG. 1 showing external details of the cap.

Looking at FIGS. 4 and 8, the plunger 60 includes part of a pushing structure 80 that pushes the flowable material from the tubular body 20 through the orifice 28 and onto the surface. The pushing structure 80 includes an annular end wall 82 that is integral with the outer sleeve 62 of the plunger 60. An inwardly directed circumferential skirt 84 is integral with the end wall 82 of the plunger 60. Four circumferentially equally spaced slats 86*a*, 86*b*, 86*c* and 86*d* extend away from the skirt 84 forming a frame. The slats 86*a*, 86*b*, 86*c* and 86*d* are connected to a generally circular inner end wall 88 of the plunger 60. Rectangular notches 90 are provided in the inner end wall 88.

Referring to FIG. 9, a movable piston head 50, which forms part of the pushing structure 80, is positioned for sealing sliding movement within the cavity 24 of the body 20. The generally circular piston head 50 has a convex domed outer surface 51 and inner mounting flanges 52 extending away from the outer surface 51. The mounting flanges 52 engage the notches 90 in the inner end wall 88 to secure the piston head 50 to the inner end wall 88 of the pushing structure 80 of the plunger 60. The piston head 50 may also be formed as an integral part of the inner end wall 88. During operation of the dispensing device 10, the plunger 60 is moved in direction D of FIGS. 2 and 3 such that flowable material contained in the body 20 between the piston head 50 and the end 26 of the body 20 is forced out of the dispensing orifice 28 of the body 20 and onto a surface.

The device 10 is structured such that accurate unitized discrete controlled doses of the flowable material can be applied to a surface. In this regard, the device includes means for indexed stepwise positioning of the end 26 of the body 20 and the inner end wall 88 (and attached piston head 50) of the inner pushing structure 80 of the plunger 60 relative to each other to provide controlled doses of the flowable adhesive material. One component of the means for indexed stepwise positioning is a guide track 30 in the outer surface 23 of the body 20. Another component of the means for indexed stepwise positioning is the set of guide pins 72*a*, 72*b* and 72*c* described above.

Figure 12:
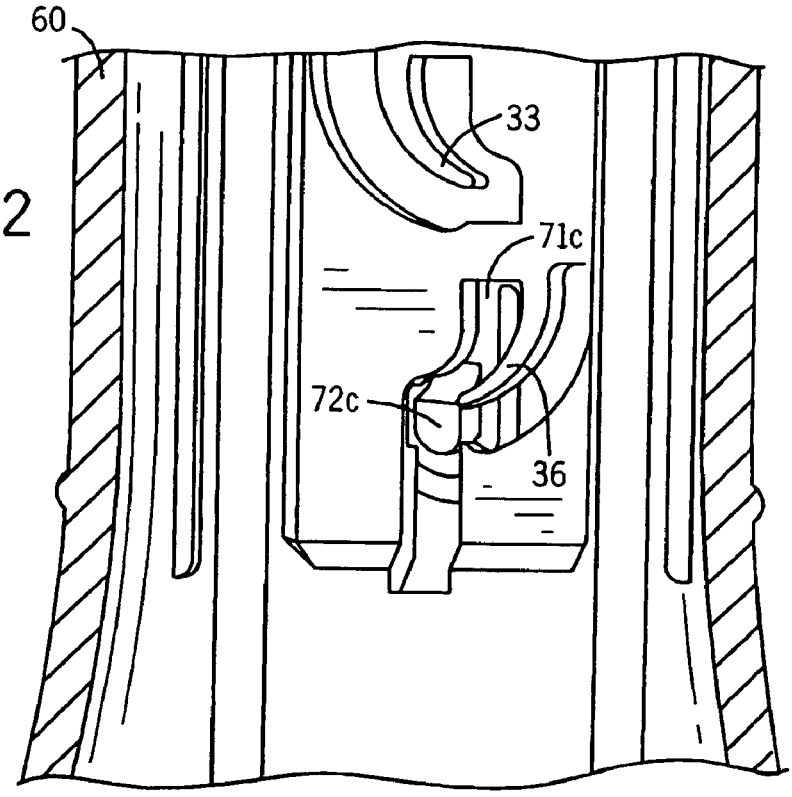
FIG. 12 is a detailed view showing the means for indexing the plunger on the flowable material containing body of the dispensing device.

Looking at FIGS. 6, 13*a*, 13*b* and 13*c*, the indexed stepwise movement of the guide pins 72*b* and 72*c* in the guide track 30 for the first three unitized doses of flowable material is shown. From top to bottom in FIGS. 6, 13*a*, 13*b* and 13*c*, the guide track 30 includes a downwardly converging open section 31, a first straight section 32, a first curved resilient arm 33, a first shoulder 34, a second straight section 35, a second curved resilient arm 36, a second shoulder 37 and a third straight section 38. The first curved resilient arm 33 and the second curved resilient arm 36 are also shown in FIG. 12. The downwardly converging open section 31, the first straight section 32, the first shoulder 34, the second straight section 35, the second shoulder 37 and the third straight section 38 are configured by way of a groove in the outer surface 23 of the end 25 of the body 20. The first curved resilient arm 33 and the second curved resilient arm 36 are configured by way of slits that go through the outer surface 23 of the end 25 of the body 20.

Figure 13A:
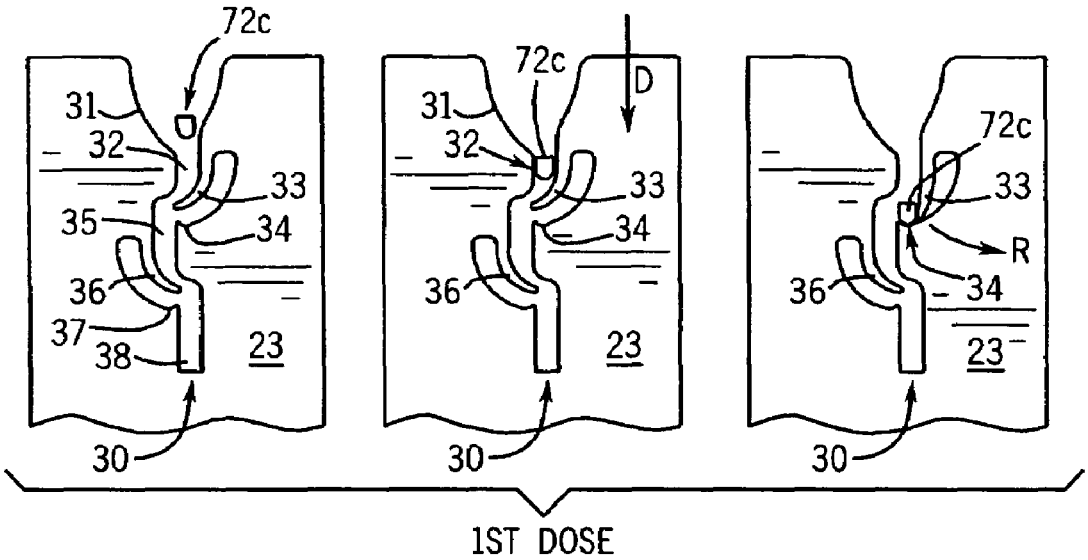

Looking at FIGS. 2 and 13*a*, when the body 20 and the plunger 60 of the device 10 are assembled by a user, the plunger 60 is moved in direction D such that the guide pin 72*c* is aligned and enters the converging open section 31 of the guide track 30 as shown in the left hand illustration in FIG. 13*a*. The front edge of each guide pin may be radiused to guide the pin on its way through the guide track 30. The body 20 and the plunger 60 may be assembled holding the body 20 and the plunger 60 in any orientation (e.g., downward, sidewise, diagonal, upward). However, for ease of illustration, the Figures show the plunger 60 being assembled over the body 20 in a downward direction D such that the outer sleeve 62 is positioned for surrounding at least a section the body 20 and the inner pushing structure 80 is positioned for axial movement in the cavity 24 of the body 20.

After a user engages the guide pin 72*c* in the converging open section 31 of the guide track 30 as shown in the left hand illustration in FIG. 13*a*, the user continues moving the plunger in direction D (see FIG. 2) such that the guide pin 72*c* enters the first straight section 32 of the guide track 30. The user continues moving the plunger in direction D such that the guide pin 72*c* moves in the first straight section 32 of the guide track 30 and then contacts the first shoulder 34 of the guide track 30 as shown in the right hand illustration of FIG. 13*a*. The first shoulder 34 stops movement of the plunger 60 in direction D. In this manner, the first straight section 32 and the first shoulder 34 of the guide track 30 provide a set distance for movement of the plunger 60 in relation to the body 20. As a result, the piston head 50, which forms the end of the pushing structure 80 of the plunger 60 as described above, moves the set distance in relation to the end 26 of the body 20 thereby forcing out a set amount of flowable material from the orifice 28 of the body 20 and onto the surface. Because of the resistance provided by the first shoulder 34, the user knows to stop pressing in direction D on the plunger 60.

Referring to the right hand illustration of FIG. 13*a*, as the plunger 60 is moved in direction D, the guide pin 72*c* pushes the first resilient arm 33 in the direction R. When the guide pin 72*c* contacts the first shoulder 34, it stops the movement in direction D, indicating to the user that one dose has been completely applied by stopping the downward movement. When the user releases pressure on the plunger 60 (pressure to move in direction D), the first resilient arm 33 is able to move back in direction L (as shown in the left hand illustration of FIG. 13*b*) and position the guide pin 72*c* to enable the second dose to be executed.

Figure 13B:
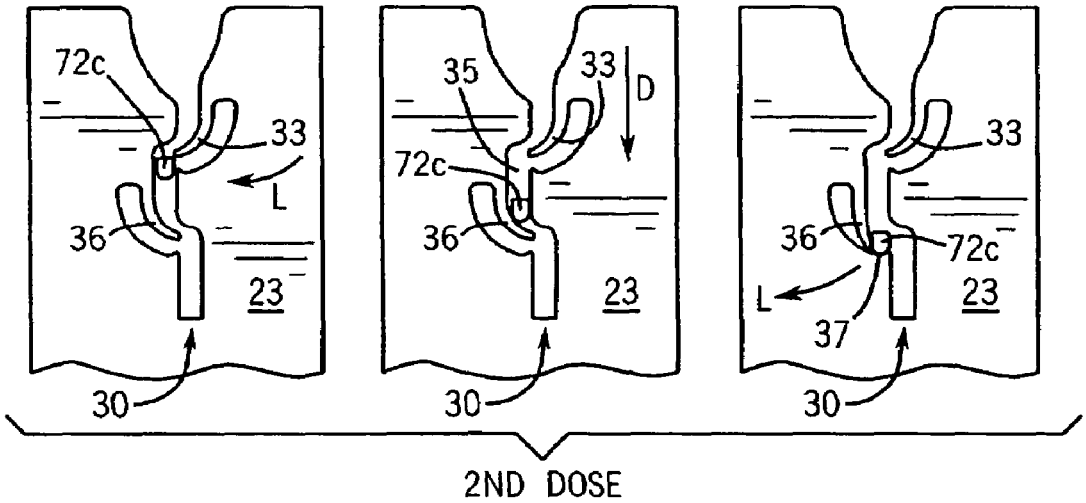

Still looking at FIG. 13*b*, when the user desires to apply a second dose, the user moves the plunger in direction D (see FIG. 2) such that the guide pin 72*c* moves downward in the second straight section 35 of the guide track 30 and then contacts the second shoulder 37 of the guide track 30 as shown in the right hand illustration of FIG. 13*b*. The second shoulder 37 stops movement of the plunger 60 in direction D. In this manner, the second straight section 35 and the second shoulder 37 of the guide track 30 provide another set distance for movement of the plunger 60 in relation to the body 20. As a result, the piston head 50, which forms the end of the pushing structure 80 of the plunger 60 as described above, moves the set distance in relation to the end 26 of the body 20 thereby forcing out a second set amount of flowable material from the orifice 28 of the body 20 and onto the surface. Because of the resistance provided by the second shoulder 37, the user knows to stop pressing in direction D on the plunger 60.

Referring to the right hand illustration of FIG. 13*b*, as the plunger 60 is moved in direction D, the guide pin 72*c* pushes the second resilient arm 36 in the direction L. When the guide pin 72*c* contacts the second shoulder 37, it stops the movement in direction D, indicating to the user that one dose has been completely applied by stopping the downward movement. When the user releases pressure on the plunger 60 (pressure to move in direction D), the second resilient arm 36 is able to move back in direction R (as shown in the left hand illustration of FIG. 13*c*) and position the guide pin 72*c* to enable the third dose to be executed.

Looking at FIG. 13*c*, when the user desires to apply a third dose, the user moves the plunger in direction D (see FIG. 2) such that guide pin 72*b* moves downward in the first straight section 32 of the guide track 30 and the guide pin 72*c* moves downward in the third straight section 38 of the guide track 30. The user continues moving the plunger in direction D such that the guide pin 72*b* moves in the first straight section 32 of the guide track 30 and then contacts the first shoulder 34 of the guide track 30 as shown in the right hand illustration of FIG. 13*c*. The first shoulder 34 stops movement of the plunger 60 in direction D. The guide pin 72*c* also passes end 39 of the guide track 30. As a result, the piston head 50, which forms the end of the pushing structure 80 of the plunger 60 as described above, moves the set distance in relation to the end 26 of the body 20 thereby forcing out a third set amount of flowable material from the orifice 28 of the body 20 and onto the surface.

Referring to the right hand illustration of FIG. 13*c*, as the plunger 60 is moved in direction D, the guide pin 72*b* pushes the first resilient arm 33 in the direction R. When the guide pin 72*b* contacts the first shoulder 34, it stops the movement in direction D, indicating to the user that one dose has been completely applied by stopping the downward movement. When the user releases pressure on the plunger 60 (pressure to move in direction D), the first resilient arm 33 is able to move back in direction L and position the guide pin 72*b* to enable the fourth dose to be executed.

When the user the desires to apply a fourth dose, the user moves the plunger in direction D (see FIG. 2) and then the guide pin 72*b* enters the second straight section 35 of the guide track 30 and moves within the guide track in the manner as depicted with respect to the guide pin 72*c* in FIG. 13*b*. Likewise, when the user desires to apply a fifth and a sixth dose, the next guide pin 72*a* then follows the same path as the guide pin 72*c* shown in FIGS. 13*a*, 13*b* and 13*c*. As a result, unitized fourth, fifth and sixth doses of flowable material are applied to a surface by way of movement of the guide pins 72*b* and 72*a* in the guide track 30.

Figure 10A:
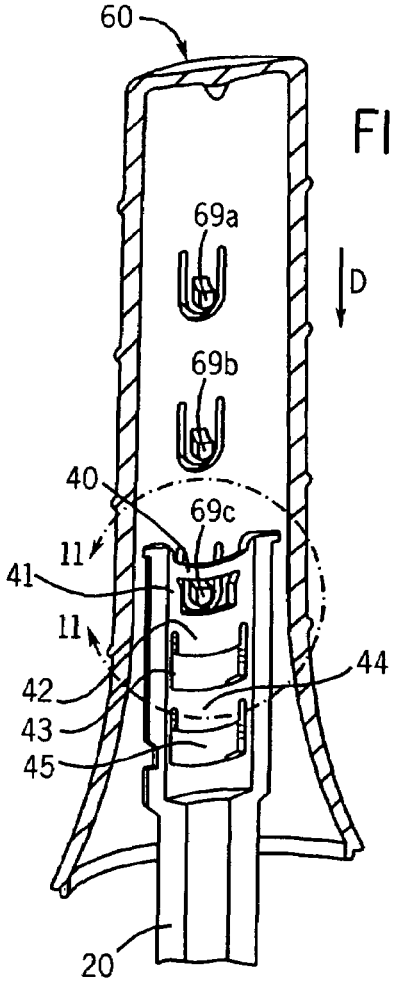
FIGS. 10*a*-10*g* are cross-sectional views similar to FIG. 9 showing the clicking operational features of the plunger indexing downward on the flowable material containing body of the dispensing device.
Figure 10B:
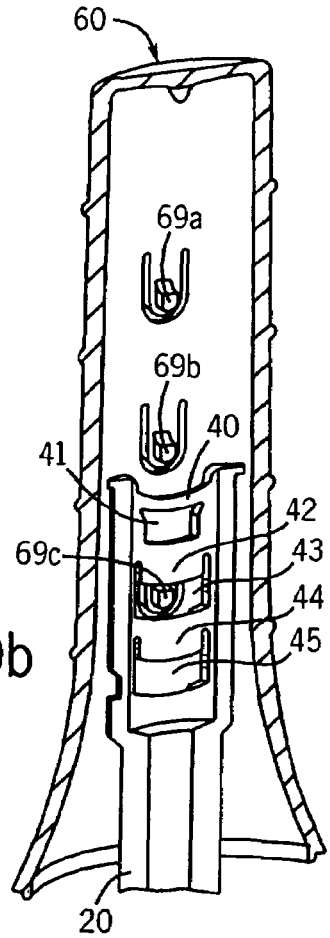
Figure 10C:
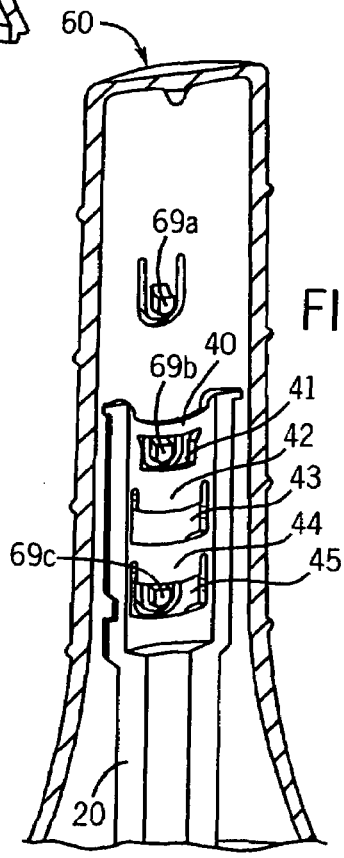
Figure 10D:
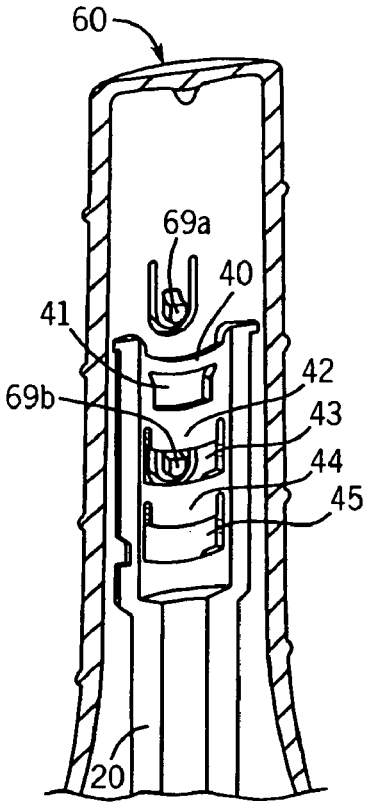
Figure 10E:
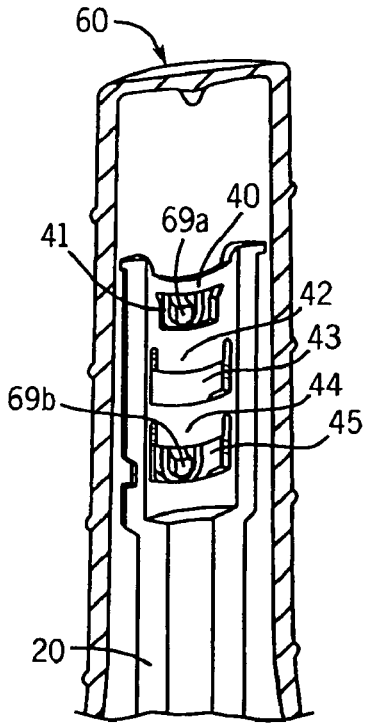
Figure 10F:
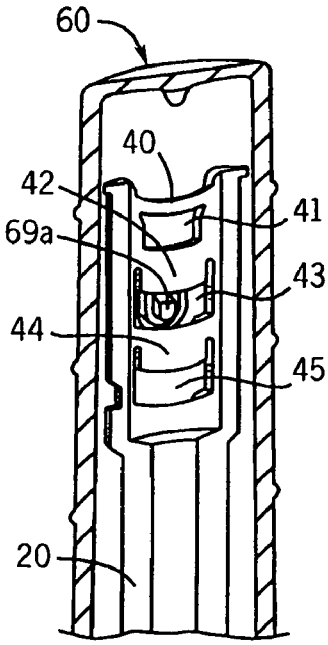
Figure 10G:
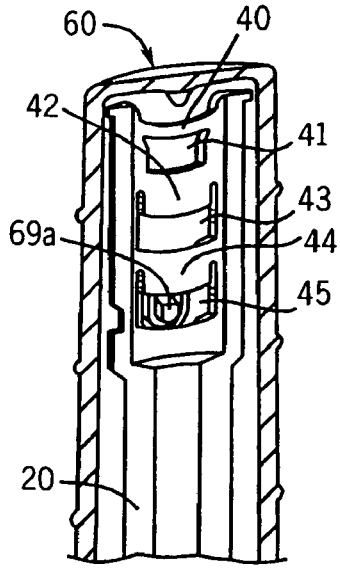
Figure 11:
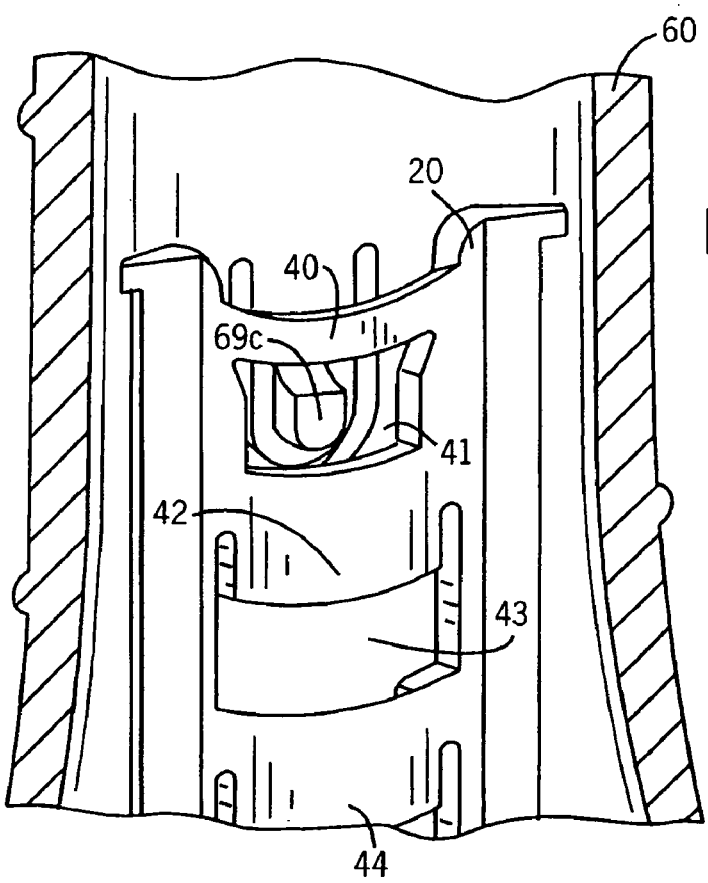
FIG. 11 is a detailed view taken from FIG. 10*a*.

In order to provide additional indication that a single dose has been applied to a surface, the device 10 also includes a means for creating a sound when the guide pins 72*a* or 72*b* or 72*c* contact the first shoulder 34 or the second shoulder 37 in the guide track 30. Looking at FIGS. 10*a*, 10*b*, 10*c*, 10*d*, 10*e*, 10*f*, 10*g* and 11, one means for creating a sound is shown. When the user assembles the plunger 60 and the body 20, the click pin 69*c* rides over slat 40 of the wall 21 of the body 20. When the click pin 69*c* has completed riding over the slat 40, the click pin 69*c* rests in click slot 41 as shown in FIGS. 10*a* and 11. By constraining the click pin 69*c* in click slot 41, it is ensured that when the device 10 is assembled, the plunger 60 and the body 20 remain intact. For example, if the device 10 is held in a position with the dispensing orifice 28 tilted downward, the body 20 does not fall out of the plunger 60.

As the user moves the plunger 60 in direction D such that the guide pin 72*c* moves in the first straight section 32 of the guide track 30, the click pin 69*c* rides over slat 42 of the wall 21 of the body 20. When the guide pin 72*c* contacts the first shoulder 34 as described above, the click pin 69*c* has completed riding over the slat 42 and moves into click slot 43 and thereafter contacts the outer surface 23 body 20 creating a clicking sound (see FIG. 10*b*). The clicking sound is synchronized with the time when guide pin 72*c* contacts the first shoulder 34. The clicking sound provides an audible signal to the user that a first dose has been completed.

As the user moves the plunger 60 in direction D such that the guide pin 72*c* moves in the second straight section 35 of the guide track 30, the click pin 69*c* rides over slat 44 of the wall 21 of the body 20. When the guide pin 72*c* contacts the second shoulder 37 as described above, the click pin 69*c* has completed riding over the slat 44 and moves into click slot 45 and thereafter contacts the outer surface 23 body 20 creating a clicking sound (see FIG. 10*c*). The clicking sound provides an audible signal to the user that another dose has been completed.

As the user again moves the plunger 60 in direction D, the click pin 69*b* rides over slat 42 of the wall 21 of the body 20. When the click pin 69*b* has completed riding over the slat 42, it moves into click slot 43 and thereafter contacts the outer surface 23 body 20 creating a clicking sound (see FIG. 10*d*). The clicking sound provides an audible signal to the user that another dose has been completed.

As the user again moves the plunger 60 in direction D, the click pin 69*b* rides over slat 44 of the wall 21 of the body 20. When the click pin 69*b* has completed riding over the slat 44, it moves into click slot 45 and thereafter contacts the outer surface 23 body 20 creating a clicking sound (see FIG. 10*e*). The clicking sound provides an audible signal to the user that another dose has been completed.

As the user again moves the plunger 60 in direction D, the click pin 69*a* rides over slat 42 of the wall 21 of the body 20. When the click pin 69*a* has completed riding over the slat 42, it moves into click slot 43 and thereafter contacts the outer surface 23 body 20 creating a clicking sound (see FIG. 10*f*). The clicking sound provides an audible signal to the user that another dose has been completed.

As the user again moves the plunger 60 in direction D, the click pin 69*a* rides over slat 44 of the wall 21 of the body 20. When the click pin 69*a* has completed riding over the slat 44, it moves into click slot 45 and thereafter contacts the outer surface 23 body 20 creating a clicking sound (see FIG. 10*g*). The clicking sound provides an audible signal to the user that another dose has been completed. After the sixth dose has been applied, the user pulls the plunger 60 away from the body 20 in a direction opposite direction D such that a refill body 20 may be assembled to the plunger 60.

Figure 15A:
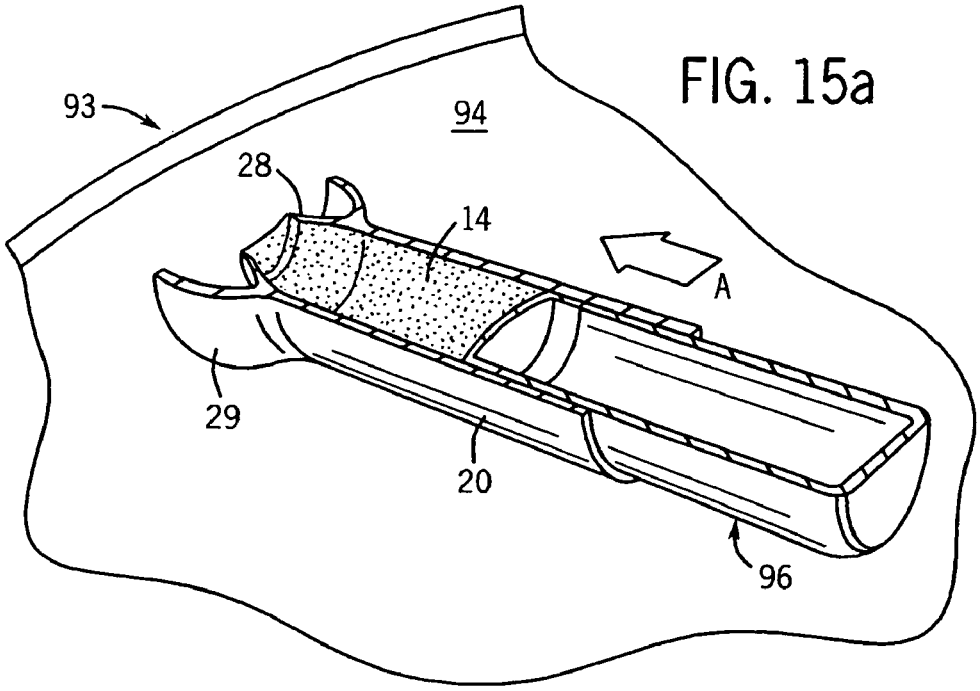
FIGS. 15*a*-15*d* shows the steps in using the dispensing device to apply a controlled dose of a cleaning, disinfecting and/or fragrancing adhesive gel to the inner surface of a toilet bowl.
Figure 15B:
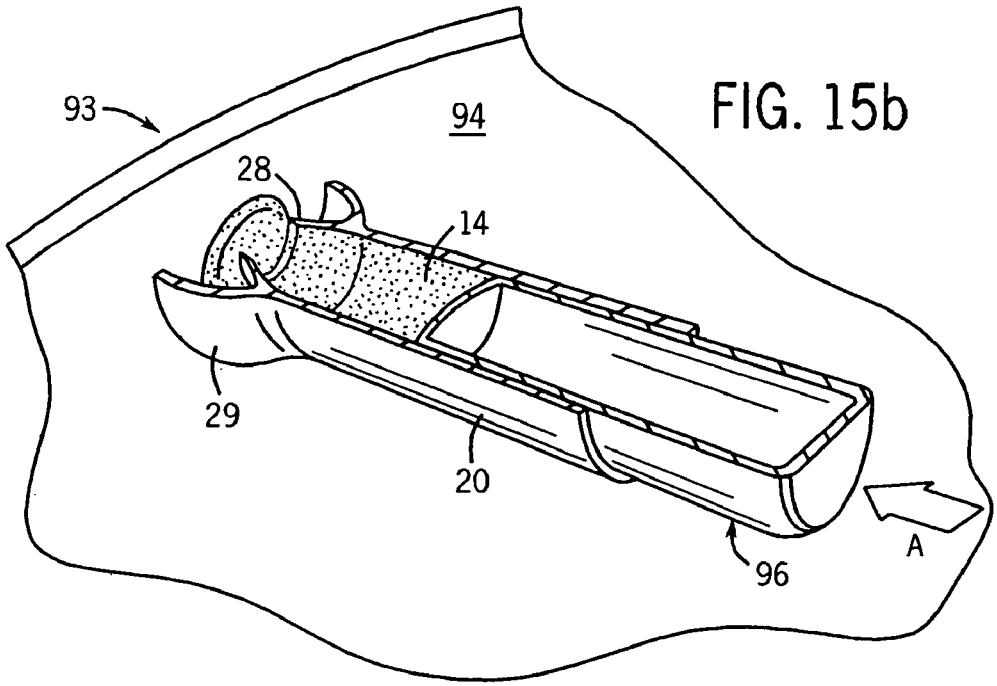
Figure 15C:
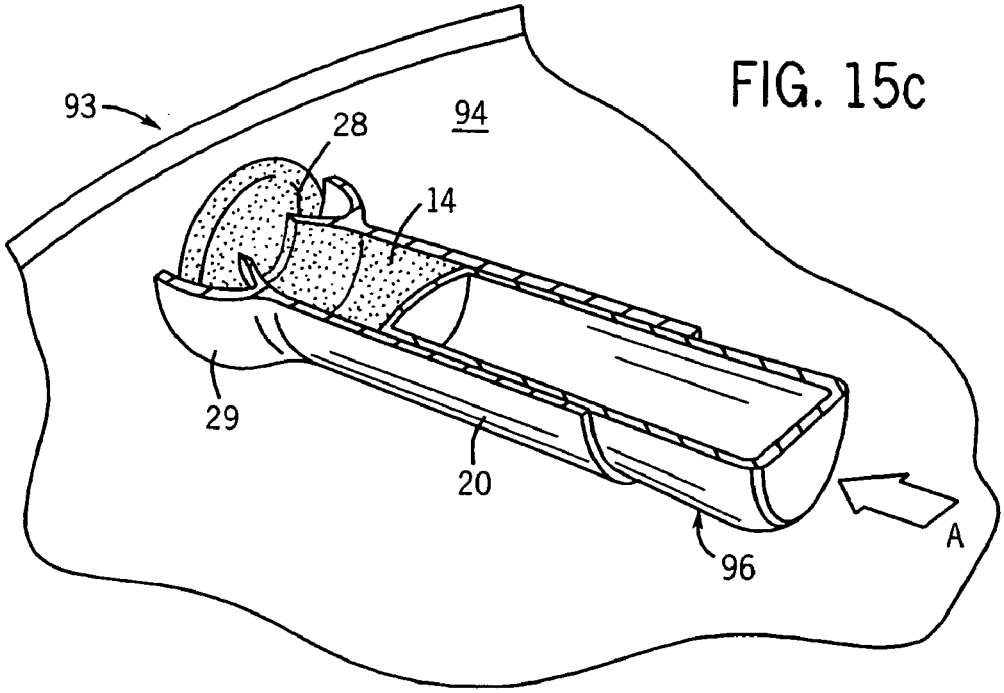
Figure 15D:
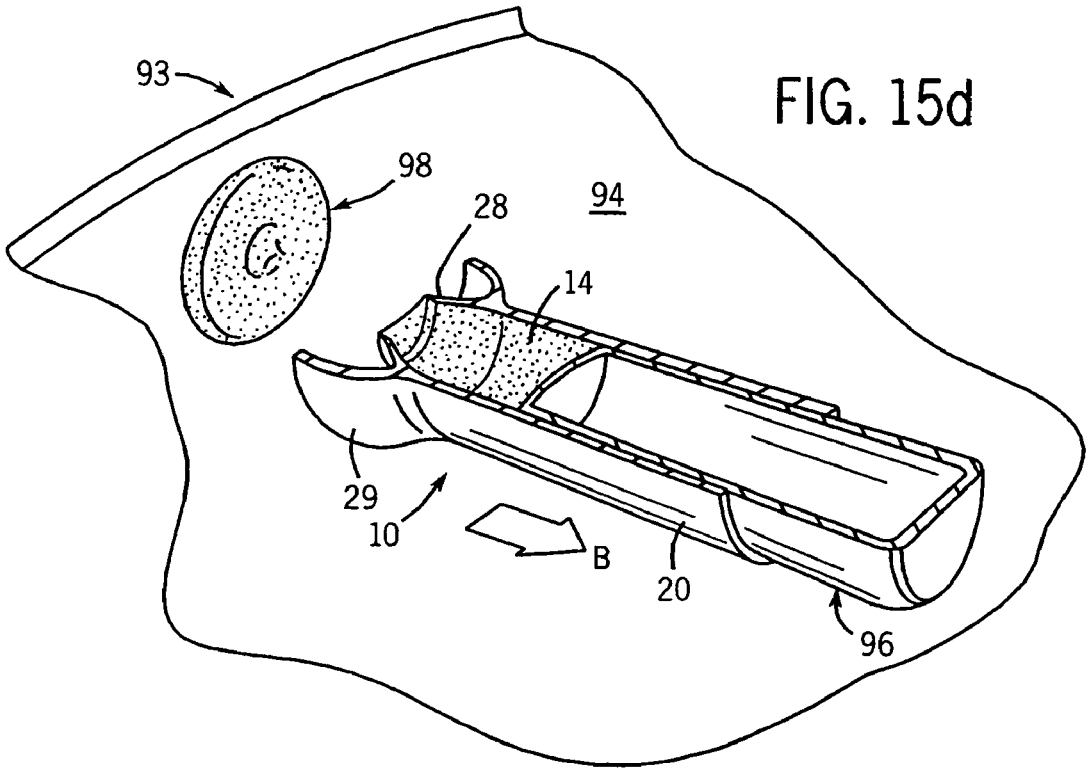

Turning now to FIGS. 14, 15*a*, 15*b*, 15*c* and 15*d*, a depiction of a process of applying an adhesive gel to a toilet bowl is shown. This example process could be used for applying any flowable material to a hard surface. The toilet bowl 93 has a rim 95 and an inner surface 94. A simplified example pushing structure 96 is shown in FIGS. 15*a* to 15*d* for clarity of illustration. Looking at FIG. 14, a user grasps the plunger 60 of the dispensing device 10 of the invention in their hand H. The user then moves the body 20 in direction A toward the inner surface 94 of the toilet bowl 93. When the shroud 29 of the body 20 contacts the inner surface 94 of the toilet bowl 93 as shown in FIG. 15*a*, the pushing structure 96 is moved in direction A by way of plunger 60. As the user holds the shroud 29 against the inner surface 94 of the toilet bowl 93 and the pushing structure 96 is continued to be moved in direction A, adhesive gel 14 exits the orifice 28 and is applied to the inner surface 94 of the toilet bowl 93. The adhesive gel 14 adheres to the inner surface 94 of the toilet bowl 93 as described in U.S. Pat. No. 6,667,286. As the pushing structure 96 is continued to be moved in direction A, more adhesive gel 14 exits the orifice 28. However, as shown in FIG. 15*c*, the shroud 29 of the body 20 molds the gel 14 as a circular mass on the inner surface 94 of the toilet bowl 93. The user then pulls the device 10 in direction B away from the inner surface 94 of the toilet bowl 93 as shown in FIG. 15*d*. The protective shroud 29 and indexed stepwise dosing produces a perfectly sized application each time, and by pulling the applicator away from the toilet bowl, the gel 14 shears away neatly to reveal the dosed application. In this regard, the gel 14 shears away outside to inside leaving a nipple of gel 14 in the center of the round disc of gel 14. While a circular disc of gel is shown adhered to the inner surface 94 of the toilet bowl 93 in the Figures, the dispensing orifice 28 of the body 20 of the device 10 can be configured to apply any shape to a surface such as oval, ellipse or polygonal (e.g., rectangle, square).

In the example device 10, six equal doses of the material are applied to a surface. Of course, the device 10 can be configured by way of a different guide track or guide pins to apply a different number of doses of material or to apply unitized doses of varied volume. After the body 20 is emptied of material, a user can simply obtain a refill body 20 that may be assembled to the plunger 60 as described above. The refill body 20 contains gel and optionally a piston head in the body. Typically, removable seals are provided on each end the refill to prevent loss or degradation of the gel in the refill body. Alternatively, after the body 20 is emptied of material, the entire device 10 can be discarded.

Turning now to FIGS. 15 to 20*f*, there is shown a second embodiment of a dispensing device 110 according to the invention. The device 110 can apply controlled unitized doses of a flowable adhesive material to a surface. In one example use, the device 110 may be used for applying controlled doses of a cleaning, disinfecting and/or fragrancing flowable adhesive gel 114 to the surface of a toilet, urinal, bathtub, shower or the like. One example gel is described in U.S. Pat. No. 6,667,286. The device 110 includes a tubular body 120 that contains the flowable material 114 and a plunger 160 that pushes the flowable material from the tubular body 120 onto the surface. A cap 135 covers the tubular body opening during storage. Typically, all of the components of the device 110 are constructed from a polymeric material such as translucent or opaque polyethylene or polypropylene. A piston 150 is positioned for sealing sliding movement within the cavity 124 of the body 120. The piston 150 has an outwardly extending piston shaft 152 and a convex domed piston head 151. The piston shaft 152 ends in a bearing surface 153.

Figure 16:
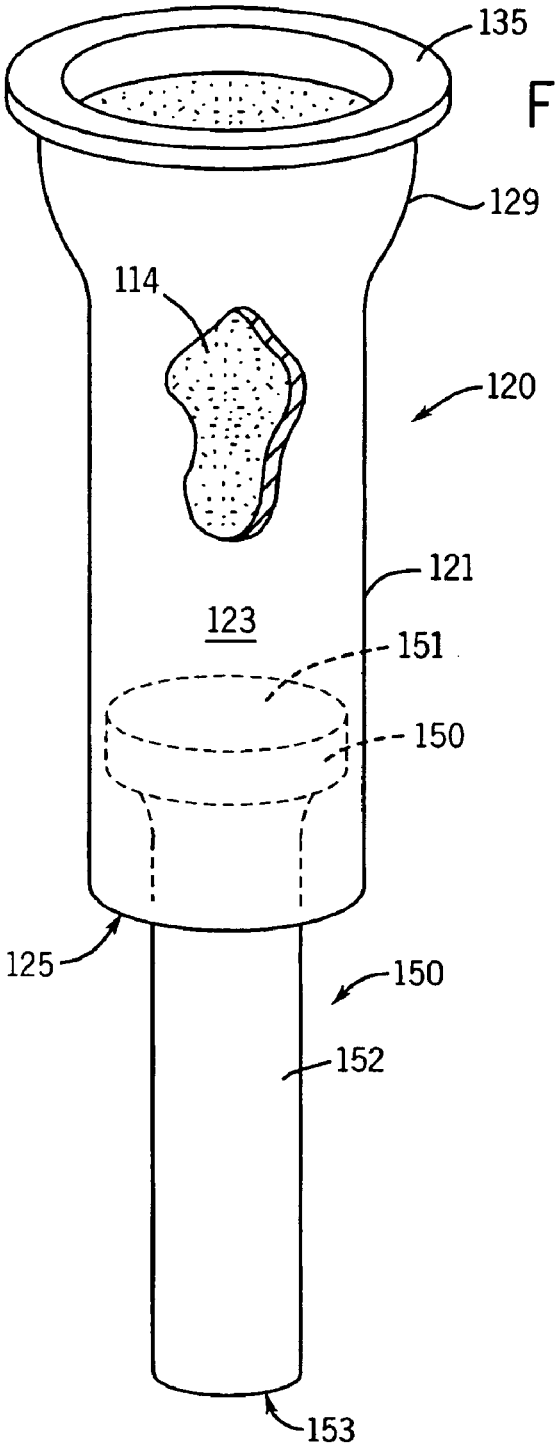
FIG. 16 is an upper right front perspective view showing a flowable material containing body and piston of a second embodiment of a dispensing device according to the invention.
Figure 18:
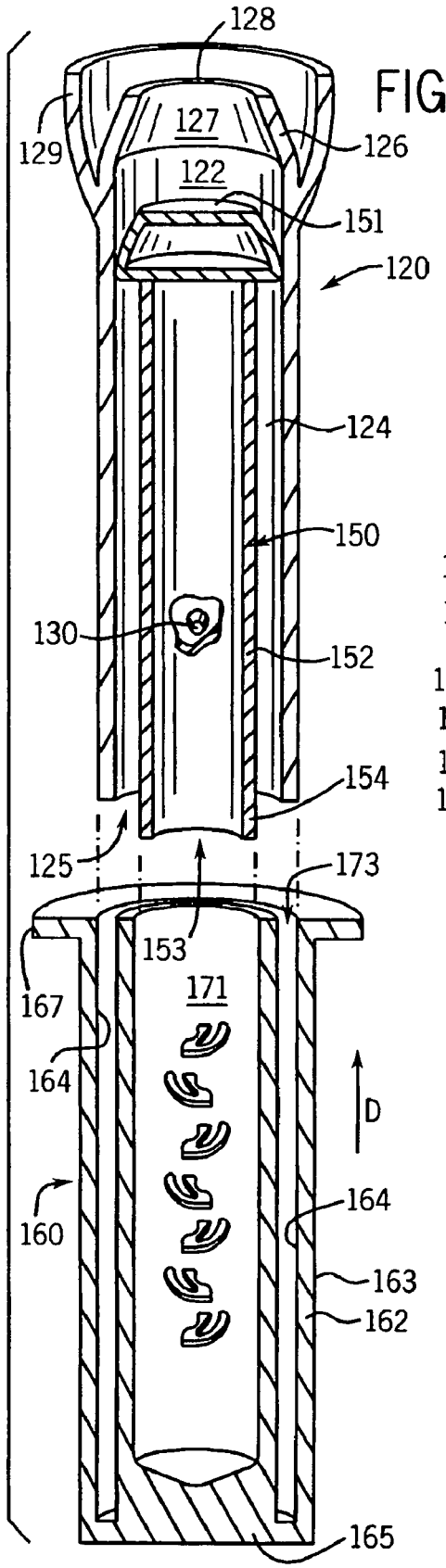
FIG. 18 is an exploded cross-sectional view of the flowable material containing body, piston and plunger of the second embodiment of a dispensing device of FIGS. 16 and 17.

Looking at FIGS. 16 and 18, the body 120 has a generally tubular cylindrical wall 121 that defines a cavity 124 for containing the flowable material 114. The wall 121 has an inner surface 122 and an outer surface 123. The body 120 has a first open end 125 and an opposite end 126 that has a wall with a concave inner surface 127 and a circular dispensing orifice 128. The end 126 also has an outwardly flaring shroud 129 that surrounds the orifice 128. A guide pin 130 extends inwardly from the inner surface 122 of the body 120 (see FIG. 18).

Figure 17:
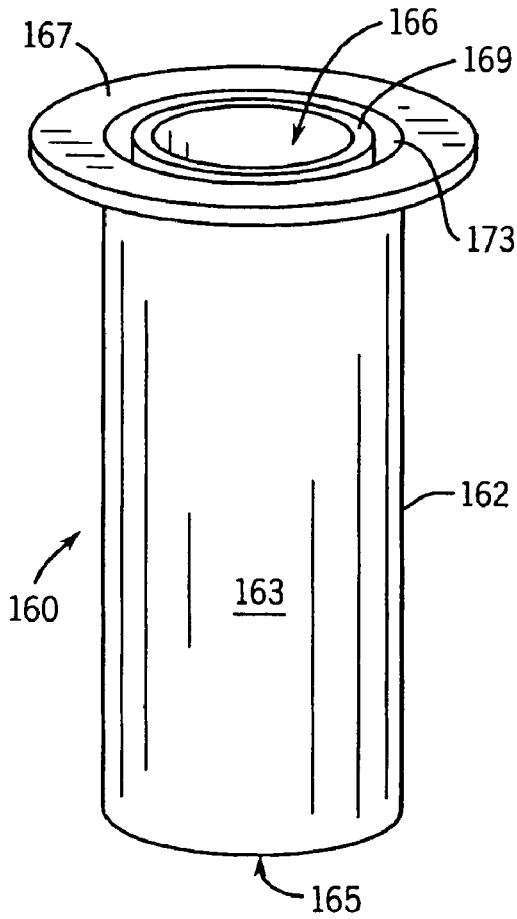
FIG. 17 is an upper right front perspective view showing a plunger of the second embodiment of the dispensing device of FIG. 16.
Figure 19:
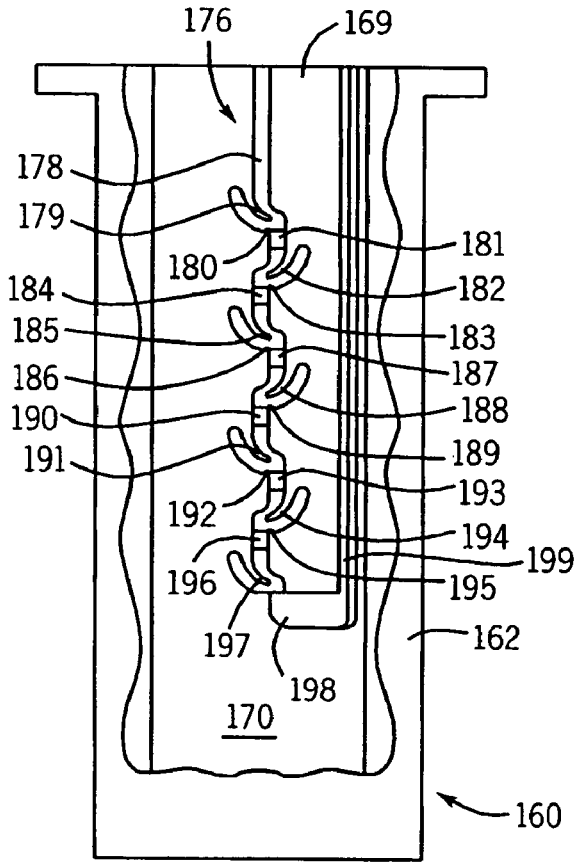
FIG. 19 is a cut out side elevational view of the plunger of FIG. 17.

Referring to FIGS. 17-19, the plunger 160 has a generally tubular cylindrical outer sleeve 162 having an outer surface 163 and an inner surface 164. The plunger 160 also has a closed end 165 and an open end 166. A flange 167 extends outwardly at the open end 166 of the plunger 160. The plunger 160 has a generally tubular cylindrical inner sleeve 169 having an outer surface 170 and an inner surface 171. An annular space 173 is formed between the outer sleeve 162 and the inner sleeve 169 of the plunger 160.

The device 110 is structured such that unitized discrete controlled doses of the flowable material can be applied to a surface. In this regard, the device 110 includes means for indexed stepwise positioning of the end 126 of the body 120 and the plunger 160 relative to each other to provide controlled doses of the flowable adhesive material. One component of the means for indexed stepwise positioning is a guide track 176 in the outer surface 170 of the inner sleeve 169 of the plunger 160. Another component of the means for indexed stepwise positioning is the guide pin 130 of the body 120.

Figure 20A:
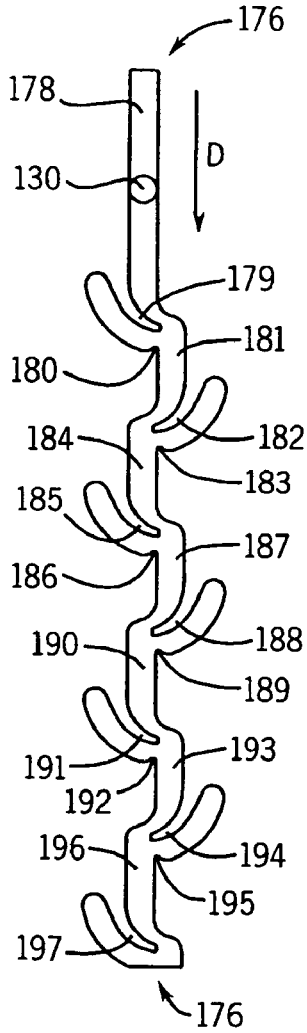
FIGS. 20*a*-20*f* are detailed views showing the movement of the guide pin in the guide track of the means for indexing the plunger on the flowable material containing body of the dispensing device of FIGS. 16-19.
Figure 20B:
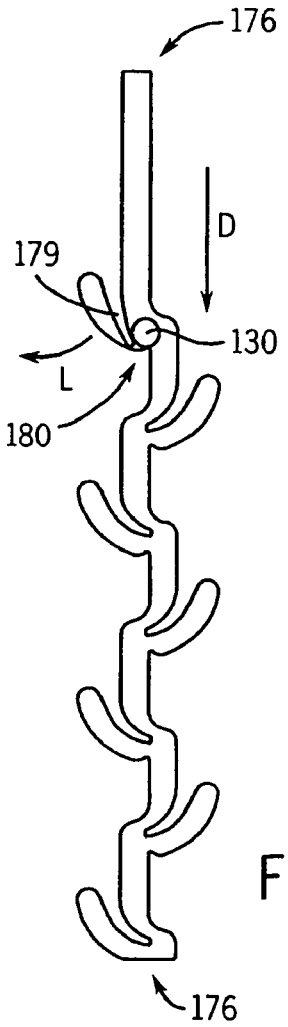
Figure 20C:
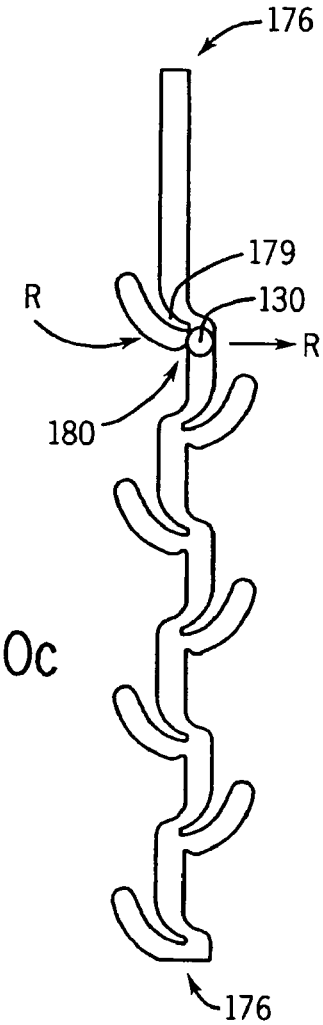
Figure 20D:
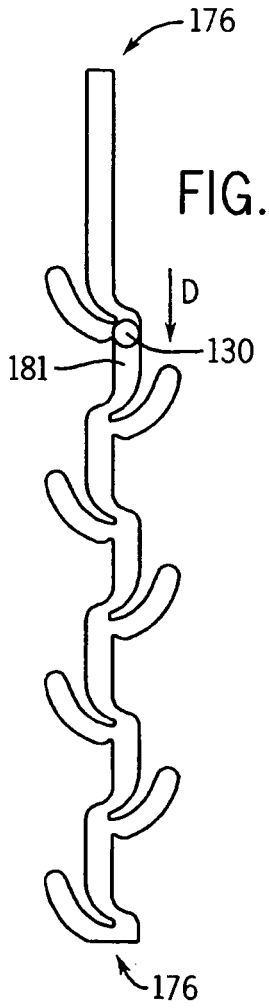
Figure 20E:
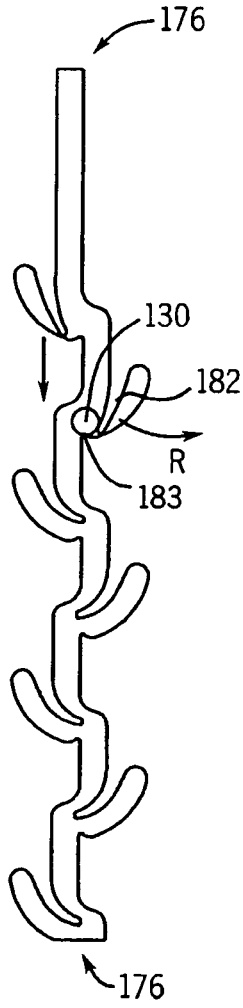
Figure 20F:
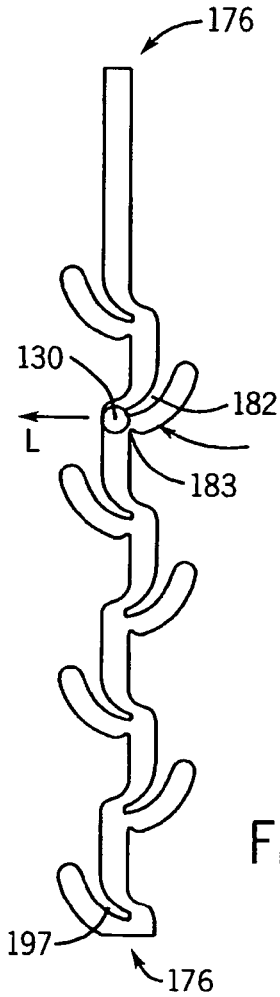

As shown in FIGS. 19 to 20*f*, the guide track 176 includes a first straight section 178, a first resilient arm 179, a first shoulder 180, a second straight section 181, a second resilient arm 182, a second shoulder 183, a third straight section 184, a third resilient arm 185, a third shoulder 186, a fourth straight section 187, a fourth resilient arm 188, a fourth shoulder 189, a fifth straight section 190, a fifth resilient arm 191, a fifth shoulder 192, a sixth straight section 193, a sixth resilient arm 194, a sixth shoulder 195, a seventh straight section 196, a seventh resilient arm 197, an eighth straight section 198, and a straight exit section 199 that extends from the eighth straight section 198 to an open end 172 of the inner sleeve 169. The first straight section 178, the first shoulder 180, the second straight section 181, the second shoulder 183, the third straight section 184, the third shoulder 186, the fourth straight section 187, the fourth shoulder 189, the fifth straight section 190, the fifth shoulder 192, the sixth straight section 193, the sixth shoulder 195, the seventh straight section 196, the eighth straight section 198, and the straight exit section 199 are configured by way of a groove in the outer surface 170 of the inner sleeve 169. The first, second, third, fourth, fifth, sixth and seventh curved resilient arms 179, 182, 185, 188, 191, 194, 197 are configured by way of slits that go through the inner sleeve 169.

Looking at FIG. 18, the body 120 and the plunger 160 of the device 110 are assembled by inserting the piston shaft 152 inside the inner surface 171 of the inner sleeve 169 and by inserting the wall 121 of the body 120 into the annular space 173 of the plunger 160. The bearing surface 153 of the piston 150 is placed in contact with the lower surface 168 of the plunger 160. As a result, further movement of the plunger 160 moves the piston 150 toward the end 126 of the body 120. The guide pin 130 of the body 120 is aligned by the user to enter the first straight section 178 of the guide track 176 as shown in FIG. 20*a*. The body 120 and the plunger 160 may be assembled holding the body 120 and the plunger 160 in any orientation (e.g., downward, sidewise, diagonal, upward). However, for ease of illustration, the Figures show the plunger 160 being assembled over the body 120 in a direction D.

After a user engages the guide pin 130 in the first section 178 of the guide track 176 as shown in FIG. 20*a*, the user continues moving the plunger in direction D (see FIG. 18). As the plunger 160 is moved in direction D, the guide pin 130 pushes the first resilient arm 179 in the direction L (see FIG. 20*b*). When the guide pin 130 contacts the first shoulder 180, it stops the movement in direction D. When the user releases pressure on the plunger 160 (pressure to move in direction D), the first resilient arm 179 is able to move back in direction R (as shown in FIG. 20*c*) and position the guide pin 130 to enable the first dose to be executed. Thus, the device 110 is now primed and ready for applying a first unitized dose of the flowable material to a surface.

When the user again moves the plunger 160 in direction D, the guide pin 130 moves in the second straight section 181 of the guide track 176 (see FIG. 20*d*). As the plunger 160 is moved in direction D, the guide pin 130 pushes the second resilient arm 182 in the direction R as shown in FIG. 20*e*. When the guide pin 130 contacts the second shoulder 183, it stops the movement in direction D. In this manner, the second straight section 181 and the second shoulder 183 of the guide track 176 provide a set distance for movement of the plunger 160 in relation to the body 120. As a result, the piston 150, which forms the end of the pushing structure, moves the set distance in relation to the end 126 of the body 120 thereby forcing out a set amount of flowable material 114 from the orifice 128 of the body 120 and onto the surface. Because of the resistance provided by the second shoulder 183, the user knows to stop pressing in direction D on the plunger 160. When the user releases pressure on the plunger 160 (pressure to move in direction D), the second resilient arm 182 is able to move back in direction L (as shown in FIG. 20*f*) and position the guide pin 130 to enable the next dose to be executed.

It can be appreciated that the sequence described in the preceding paragraph can be repeated for movement of the guide pin 130 with respect to: (i) the third straight section 184, the third shoulder 186 and the third resilient arm 185 for providing a second dose of the flowable material, (ii) the fourth straight section 187, the fourth shoulder 189 and the fourth resilient arm 188 for providing a third dose of the flowable material, (iii) the fifth straight section 190, the fifth shoulder 192 and the fifth resilient arm 191 for providing a fourth dose of the flowable material, (iv) the sixth straight section 193, the sixth shoulder 195 and the sixth resilient arm 194 for providing a fifth dose of the flowable material, and (v) the seventh straight section 196 and the seventh resilient arm 197 for providing a sixth dose of the flowable material. Thus, the dispensing device 110 can accurately apply six unitized, controlled doses of an adhesive gel 114 to a toilet bowl in the manner described above with reference to FIGS. 14, 15*a*, 15*b*, 15*c* and 15*d*. After the sixth dose has been applied, the user turns the plunger 160 such that the guide pin 130 travels laterally in the eighth straight section 198 and then the user may remove the body 120 from the plunger 160 by way of movement of the guide pin 130 in the exit section 199 of the guide track 176 toward the end 172 of the inner sleeve 169 of the plunger 160.

In the second example device 110, six doses of the material are applied to a surface. Of course, the device 110 can be configured by way of a different guide track or guide pins to apply a different number of doses of material or to apply variable volume unitized doses. After the body 120 is emptied of material, a user can simply obtain a refill body 120 with a piston 150 that may be assembled to the plunger 160 as described above. Typically, removable seals are provided on each end the refill to prevent loss or degradation of the gel in the refill body. In an alternative arrangement, the piston shaft 152 may be integral with the plunger 160 and only a domed piston head 151 may be in refill bodies.

Figure 21:
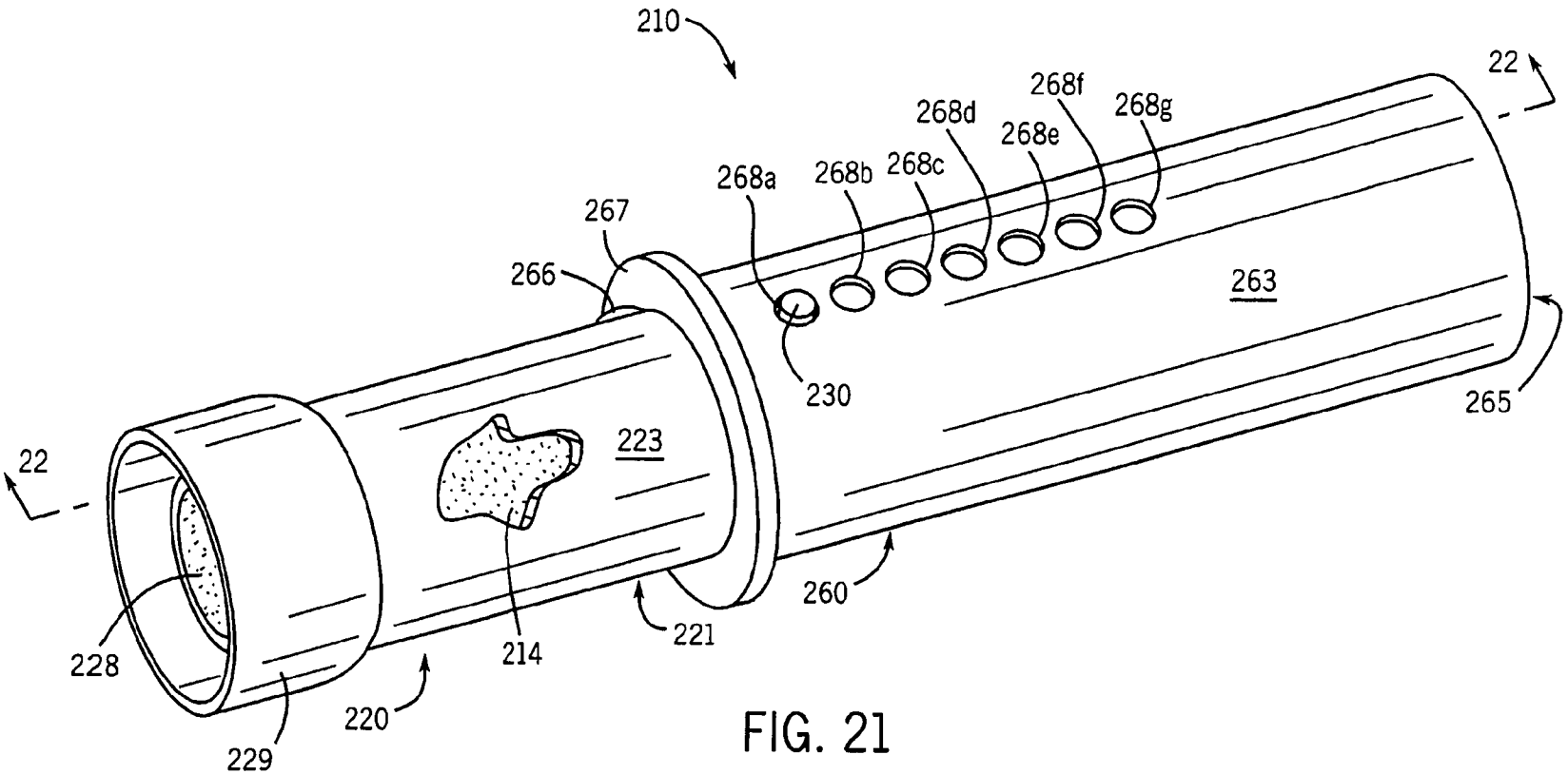
FIG. 21 is a perspective view showing an assembled flowable material containing body and plunger of a third embodiment of a dispensing device according to the invention.
Figure 22:
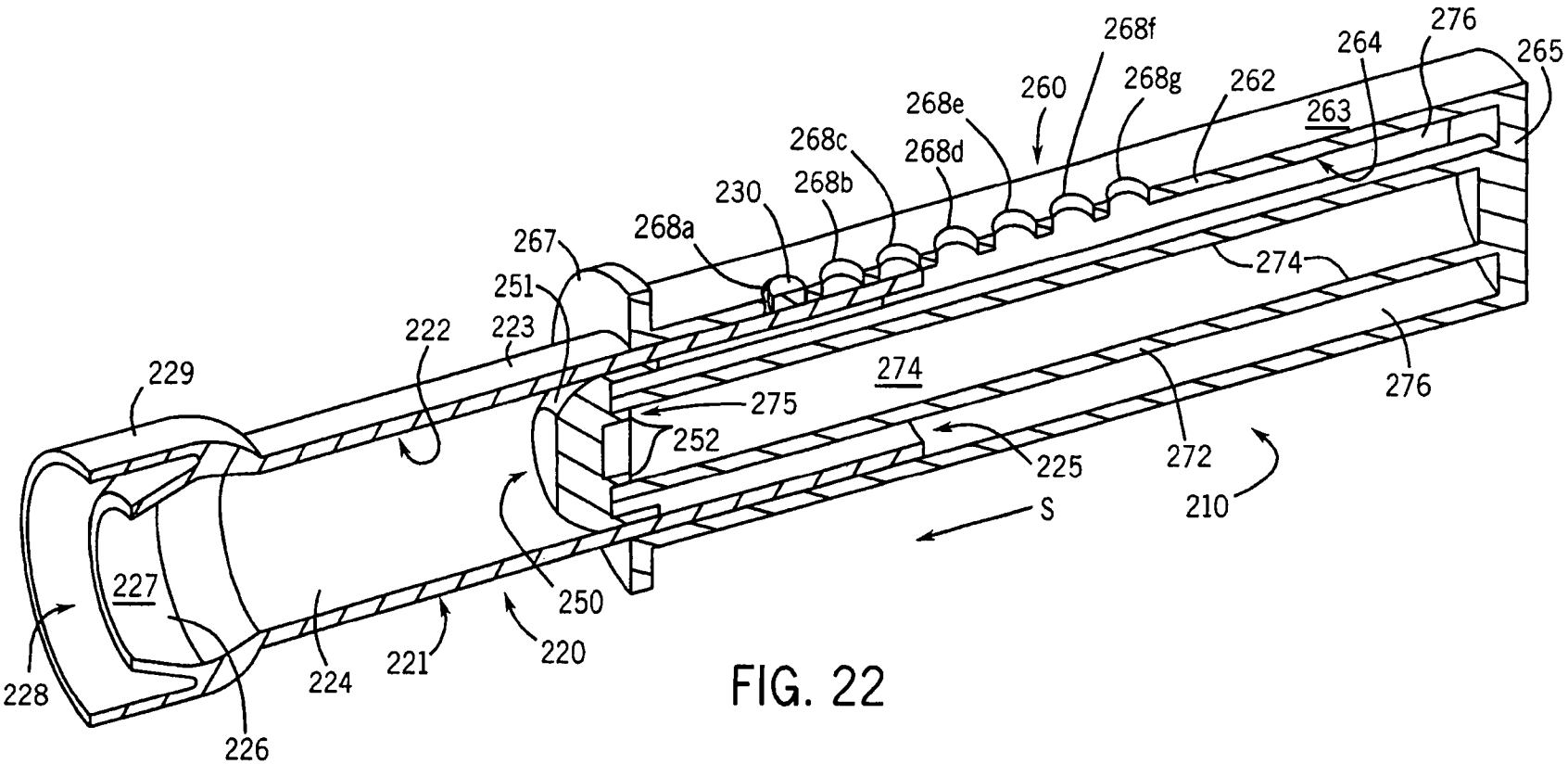
FIG. 22 is a cross-sectional view of the dispensing device of FIG. 21 taken along line 22-22 of FIG. 21.

Turning now to FIGS. 21 and 22, there is shown a third embodiment of a dispensing device 210 according to the invention. The device 210 can apply controlled unitized doses of a flowable adhesive material to a surface. In one example use, the device 210 may be used for applying controlled doses of a cleaning, disinfecting and/or fragrancing flowable adhesive gel 214 to the surface of a toilet, urinal, bathtub, shower or the like. One example gel is described in U.S. Pat. No. 6,667,286. The device 210 includes a tubular body 220 that contains the flowable material 214 and a plunger 260 that pushes the flowable material from the tubular body 220 onto the surface. A cap similar to caps 54 and 135 described above may cover the tubular body opening during storage. Typically, all of the components of the device 210 are constructed from a polymeric material such as translucent or opaque polyethylene or polypropylene. A piston head 250 is positioned for sealing sliding movement within the cavity 224 of the body 220. The generally circular piston head 250 has a convex domed outer surface 251 and a outwardly extending annular ring 252 opposite the convex domed outer surface 251.

Still looking at FIGS. 21 and 22, the body 220 has a generally tubular cylindrical wall 221 that defines a cavity 224 for containing the flowable material 214. The wall 221 has an inner surface 222 and an outer surface 223. The body 220 has a first open end 225 and an opposite end 226 that has a wall with a concave inner surface 227 and a circular dispensing orifice 228. The end 226 also has an outwardly flaring shroud 229 that surrounds the orifice 228. An inwardly movable guide pin 230 extends outwardly from the outer surface 223 of the body 220.

Still referring to FIGS. 21 and 22, the plunger 260 has a generally tubular cylindrical outer sleeve 262 having an outer surface 263 and an inner surface 264. The plunger 260 also has a closed end 265 and an open end 266. A flange 267 extends outwardly at the open end 266 of the plunger 260. The plunger 260 has a generally tubular cylindrical inner sleeve 272 having an outer surface 273 and an inner surface 274. An annular space 276 is formed between the outer sleeve 262 and the inner sleeve 272 of the plunger 260.

The device 210 is structured such that unitized discrete controlled doses of the flowable material can be applied to a surface. In this regard, the device 210 includes means for indexed stepwise positioning of the end 226 of the body 220 and the plunger 260 relative to each other to provide controlled doses of the flowable adhesive material 214. One component of the means for indexed stepwise positioning is a group of throughholes 268*a*, 268*b*, 268*c*, 268*d*, 268*e*, 268*f*, 268*g* in the outer sleeve 262 of the plunger 260. Another component of the means for indexed stepwise positioning is the inwardly movable guide pin 230 of the body 220.

Looking at FIGS. 21 and 22, the body 220 and the plunger 260 of the device 210 are assembled by inserting the wall 221 of the body 220 into the annular space 276 of the plunger 260. The annular ring 252 of the piston head 250 is also press fit into the open end 275 of the inner sleeve 272 of the plunger 260. As a result, further movement of the plunger 260 moves the piston head 250 toward the end 226 of the body 220. The guide pin 230 of the body 220 is first positioned by the user in the throughhole 268*a* of the plunger 260. Slits that extend through the wall 221 of the body 220 may be provided around the guide pin 230 (e.g., such as the slits that form tabs 71*a*, 71*b*, 71*c* in FIG. 1) to allow the guide pin 230 to flex inward. The body 220 and the plunger 260 may be assembled holding the body 220 and the plunger 260 in any orientation (e.g., downward, sidewise, diagonal, upward). However, for ease of illustration, the Figures show the plunger 260 being assembled over the body 220 in a direction S. After a user engages the guide pin 230 in the throughhole 268*a* of the plunger 260, the device 210 is primed and ready for applying a first unitized dose of the flowable material 214 to a surface.

When the user again moves the plunger 260 in direction S, the guide pin 230 flexes inward and moves toward and then enters the throughhole 268*b*. In this manner, the throughhole 268*a* and the throughhole 268*b* provide a set distance for movement of the plunger 260 in relation to the body 220. As a result, the piston head 250, which forms the end of the pushing structure, moves the set distance in relation to the end 226 of the body 220 thereby forcing out a set amount of flowable material 214 from the orifice 228 of the body 220 and onto the surface. Because of the resistance provided by the guide pin 230 entering the throughhole 268*b*, the user knows to stop pressing in direction S on the plunger 260.

It can be appreciated that the sequence described in the preceding paragraph can be repeated for movement of the guide pin 230 into the throughhole 268*c* for providing a second dose of the flowable material, the throughhole 268*d* for providing a third dose of the flowable material, the throughhole 268*e* for providing a fourth dose of the flowable material, the throughhole 268*f* for providing a fifth dose of the flowable material, and the throughhole 268*g* for providing a sixth dose of the flowable material. Thus, the dispensing device 210 can accurately apply six unitized, controlled doses of an adhesive gel 214 to a toilet bowl in the manner described above with reference to FIGS. 14, 15*a*, 15*b*, 15*c* and 15*d*. After the sixth dose has been applied, the user turns the plunger 260 such that the guide pin 230 laterally exits the throughhole 268*g* and then the user may remove the body 220 from the plunger 260 by way of movement of body 220 away from the plunger 260.

In the third example device 210, six doses of the material are applied to a surface. Of course, the device 210 can be configured by way of a different number of throughholes to apply a different number of doses of material or by differently spaced throughholes to apply variable volume unitized doses. After the body 220 is emptied of material, a user can simply obtain a refill body 220 with flowable material 214 and a piston head 250 that may be assembled to the plunger 260 as described above. Typically, removable seals are provided on each end the refill to prevent loss or degradation of the gel in the refill body. In an alternative arrangement, the piston head 250 may be integral with the plunger 260.

Thus, the invention provides devices for applying controlled doses of a flowable adhesive material to a surface. The devices have many advantages. For example, the device 10 provides for controlled equal unitized dosing volume by way of a plunger 60 with integrated guide pins 72*a*, 72*b* and 72*c* and click pins 69*a*, 69*b*, 69*c*, and a body 20 with integrated click slots 41, 43, 45 and guide track 30 that control indexed stepwise movement of the plunger 60. Also, by having a combination of three click pins/guide pins and two click slots/stop tracks, six doses can be achieved with the minimum length of features that would otherwise reduce the volume of gel in body. Further, the same dimensioned pin is used on both sides of the plunger 60 for the guide pins 72*a*, 72*b* and 72*c* and click pins 69*a*, 69*b*, 69*c* to allow 180 degrees rotation thereby enabling the applicator to be assembled in both orientations.

In addition, the flared end 66 of the plunger 60 acts as a feature to keep the user's hand away from toilet bowl and to provide good control and grip of the plunger 60. Also, by providing the piston head with a convex domed outer surface 51, 151, 251 substantially all of the gel is extruded out of the body 20, 120, 220 thereby avoiding waste. In addition, the "inverted syringe" operation of the device provides for more control.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention relates to a device for accurately applying controlled unitized doses of a flowable adhesive material to a surface. In one use, the device may be used for applying controlled doses of a cleaning, disinfecting and/or fragrancing adhesive gel to the surface of a toilet, urinal, bathtub or shower.

What is claimed is:

1. A device for applying controlled doses of a flowable adhesive material to a surface, the device comprising:

a tubular body having a wall defining a cavity, the body having a first open end and an opposite second end having a dispensing orifice;

a flowable adhesive material in the cavity;

a plunger having an outer sleeve dimensioned for surrounding at least a section the body and having an inner pushing structure dimensioned for axial movement in the cavity; and means for indexed positioning of the second end of the body and an inner end of the inner pushing structure of the plunger relative to each other to provide controlled doses of the flowable adhesive material such that the controlled doses of the flowable adhesive material may be applied to the surface when the plunger is moved toward the dispensing orifice, and wherein the means for indexed positioning comprises a guide track and a guide pin that travels stepwise in the guide track, one of the guide track and the guide pin being located on an outer surface of the body and the other of the guide track and the guide pin being located on the outer sleeve of the plunger.

2. The device of claim 1 wherein:

an end of the outer sleeve of the plunger is outwardly flaring.

3. The device of claim 1 wherein:

the dispensing orifice is circular, oval, ellipse or polygonal.

4. The device of claim 1 wherein:

the second end of the body has an end wall having a concave inner surface, and the inner end of the pushing structure of the plunger has a convex outer surface that substantially conforms to the concave inner surface of the end wall of the second end of the body.

5. The device of claim 1 wherein:

the guide pin is movably attached to the outer surface of the body and the guide track is located on the outer sleeve of the plunger, the guide track comprising a plurality of aligned throughholes dimensioned to receive the guide pin.

6. The device of claim 1 wherein:

the means for indexed positioning further comprises means for creating a sound as the guide pin travels stepwise in the guide track.

7. The device of claim 1 wherein:

the pushing structure includes a pushing frame and a separate piston head, and the pushing frame engages the piston head.

8. The device of claim 1 wherein:

the pushing structure includes a separate piston, and an inner surface of the pushing structure engages the piston.

9. The device of claim 1 wherein:

the body includes a shroud that extends away from the second end of the body and surrounds the dispensing orifice, the shroud being radially outwardly spaced from the dispensing orifice.

10. A device for dispensing controlled doses of a flowable material, the device comprising:

a tubular body having a wall defining a cavity suitable for holding the flowable material, the body having a first open end and an opposite second end having a dispensing orifice;

a plunger having an outer sleeve dimensioned for surrounding at least a section the body and having an inner pushing structure dimensioned for axial movement in the cavity; and means for indexed positioning of the second end of the body and an inner end of the inner pushing structure of the plunger relative to each other to provide controlled doses of the flowable material when the plunger is moved toward the dispensing orifice, wherein the means for indexed positioning comprises a guide track and a guide pin that travels stepwise in the guide track, one of the guide track and the guide pin being located on the body and the other of the guide track and the guide pin being located on the outer sleeve of the plunger.

11. The device of claim 10 wherein:

an end of the outer sleeve of the plunger is outwardly flaring.

12. The device of claim 10 wherein:

the dispensing orifice is circular, oval, ellipse or polygonal.

13. The device of claim 10 wherein:

the second end of the body has an end wall having a concave inner surface, and the inner end of the pushing structure of the plunger has a convex outer surface that substantially conforms to the concave inner surface of the end wall of the second end of the body.

14. The device of claim 10 wherein:

the guide pin is movably attached to an outer surface of the body and the guide track is located on the outer sleeve of the plunger, the guide track comprising a plurality of aligned throughholes dimensioned to receive the guide pin.

15. The device of claim 10 wherein:

the means for indexed positioning further comprises means for creating a sound as the guide pin indexes in the guide track.

16. The device of claim 10 wherein:

the pushing structure includes a pushing frame and a separate piston head, and the pushing frame engages the piston head.

17. The device of claim 10 wherein:

the pushing structure includes a separate piston, and an inner surface of the pushing structure engages the piston.

18. The device of claim 10 wherein:

the body includes a shroud that extends away from the second end of the body and surrounds the dispensing orifice, the shroud being radially outwardly spaced from the dispensing orifice.

19. A refill for a device for dispensing controlled doses of a flowable material, the device including a plunger having an outer sleeve with a guide track comprising throughholes in the outer sleeve, the refill comprising:

a tubular body having a wall defining a cavity, the body having a first open end and an opposite second end having a dispensing orifice, the body having an inwardly movable guide pin attached to an outer surface of the body; and a flowable material in the cavity, wherein the guide pin is dimensioned to be received in the throughholes of the guide track.

20. The refill of claim 19 further comprising:

a piston head located in the first open end of the cavity.

21. The refill of claim 19 wherein:

the flowable material is a cleaning, disinfecting and/or fragrancing adhesive gel.

22. The refill of claim 21 wherein:

the flowable material is an adhesive gel suitable for application to a toilet, urinal, bathtub or shower.

23. The refill of claim 19 wherein:

the body includes a shroud that extends away from the second end of the body and surrounds the dispensing orifice, the shroud being radially outwardly spaced from the dispensing orifice.

24. The device of claim 1 wherein the flowable adhesive material is a cleaning, disinfecting and/or fragrancing gel.

25. The device of claim 24 wherein the flowable adhesive material is an adhesive gel suitable for application to a toilet, urinal, bathtub or shower.

* * * * *